US007010825B1

(12) United States Patent
Finch Salas et al.

(10) Patent No.: US 7,010,825 B1
(45) Date of Patent: Mar. 14, 2006

(54) TELESCOPING RAMP

(75) Inventors: Barbara Kaye Finch Salas, Cranberry, PA (US); Reynaldo Thomas Salas, Jr., Cranberry, PA (US); Andrew Baker Maitland, Cranberry, PA (US)

(73) Assignee: Goldfinch Enterprises, Inc., Hershey, PA (US)

( * ) Notice: Subject to any disclaimer, the term of this patent is extended or adjusted under 35 U.S.C. 154(b) by 14 days.

(21) Appl. No.: 10/924,347

(22) Filed: Aug. 24, 2004

Related U.S. Application Data

(63) Continuation-in-part of application No. 10/637,461, filed on Aug. 8, 2003, now abandoned.

(51) Int. Cl.
*E01D 15/10* (2006.01)

(52) U.S. Cl. ..... 14/72.5; 14/69.5

(58) Field of Classification Search ..... 14/72.5, 14/69.5

See application file for complete search history.

(56) References Cited

U.S. PATENT DOCUMENTS

| | | | | |
|---|---|---|---|---|
| 3,933,258 | A * | 1/1976 | Forsyth et al. | 414/537 |
| 4,081,091 | A | 3/1978 | Thorley | 214/75 R |
| 4,457,402 | A | 7/1984 | Del Vecchio et al. | 187/12 |
| 4,479,753 | A | 10/1984 | Thorley | 414/540 |
| 4,628,561 | A | 12/1986 | Kushniryk | 14/69.5 |
| 4,900,217 | A * | 2/1990 | Nelson | 414/537 |
| 4,929,108 | A | 5/1990 | Carty | 296/204 |
| 5,137,114 | A | 8/1992 | Yde et al. | 182/49 |
| 5,244,335 | A | 9/1993 | Johns | 414/537 |
| 5,312,149 | A | 5/1994 | Boone | 296/61 |
| 5,803,523 | A | 9/1998 | Clark et al. | 296/26.1 |
| 5,813,071 | A | 9/1998 | Breslin et al. | 14/71.1 |
| 6,109,854 | A | 8/2000 | Thompson, Jr. et al. | 414/398 |
| 6,345,950 | B1 | 2/2002 | Gerwitz | 414/537 |
| 6,484,344 | B1 | 11/2002 | Cooper | 14/71.1 |
| 6,526,614 | B1 * | 3/2003 | Anderson et al. | 14/69.5 |
| 6,722,612 | B1 * | 4/2004 | Konya | 244/137.2 |

* cited by examiner

*Primary Examiner*—Raymond W Addie
(74) *Attorney, Agent, or Firm*—Wayne L. Lovercheck

(57) ABSTRACT

A telescoping ramp assembly incorporates one or more sloping deck ramp sections which nest inside one another; are mounted on wheels; and have pull-up/fold-down railing sections which rise/lower and link/unlink as the ramp sections, powered manually or by way of a motor, retract and extend upon a firm surface from underneath a housing porch which itself is fixed to the entrance way of a home or building.

34 Claims, 39 Drawing Sheets

TELESCOPING RAMP

CROSS REFERENCE TO RELATED APPLICATIONS

This application is a continuation-in-part of U.S. application Ser. No. 10/637,461 filed Aug. 8, 2003 now abandoned.

STATEMENT REGARDING FEDERALLY SPONSORED RESEARCH OR DEVELOPMENT

Not Applicable

BACKGROUND OF THE INVENTION

A ramp, as defined in the Webster Dictionary, is (1) "An incline plane serving as a way between different interior levels"; and, (2) "A sloping roadway or passageway". This is the field of invention.

The idea or invention of a ramp was conceived many thousands of years ago. It is thought by some historians that ramps were used in the construction industry as far back as 3000 B.C. when the Egyptians used them in the building of the pyramids. And ramps continue to be used to this very day—not only in the conveyance of material but also in the conveyance of people: people who are most often disabled.

There are two basic kinds of ramps for home, business and industrial use: permanent and movable.

And there are major differences between them. On the one hand, permanent ramps are made to order: fixed to a structure; strongly built; and not meant to be moved from their stationary position. In most private situations, permanent ramps are made of wood or earth, while in public access buildings the ramps are more often made of concrete and/or metal. But no matter the material used, the permanent ramp is usually set firmly into the ground. Consequently removal becomes very difficult. Also permanent ramps almost always have railings, and when placed on/in public buildings, these ramps and railings must conform to the OSHA safety standards.

On the other hand, movable ramps are made to be moved and are usually put into place whenever the need arises. They are then usually removed and stored. Movable ramps also fit in numerous places and situations. They are often made of light-weight material and are easily moved from place to place. However movable ramps do not have railings. This in itself presents some danger. However in most instances these ramps cannot and are not meant to conform to the OSHA regulations regarding railings.

Presently there are U.S. companies manufacturing and selling movable ramps, which meet the required OSHA standards. One such company is Prairie View Industries Inc. of Fairbury, Nebr. In their information brochure, PVI demonstrates through color photographs their Single Fold and Multifold Ramps. The brochure also points out that this particular ramp is of all aluminum construction and "folds down and carries like a suitcase".

Both types of ramps however come with problems. For example, a permanent ramp often takes up valuable space when it is not in use. Also the architectural design of the permanent ramp is often ill conceived causing it, and the attached structure, to look unattractive. Another major complaint, especially by those who are disabled, is that it "screams" disability to all those who pass by. In addition it is often difficult to find someone to build the permanent ramp, and then when built, to keep it maintained. Also in northern climes, the removal of snow from the permanent ramp often becomes a dangerous burden.

Likewise the movable ramp has its problems. Movable ramps run the gamut from nothing more than a board being placed between a semi-truck and a loading dock, to a fine looking folding metal ramp spanning the space between a home doorway and the ground. But regardless of its make-up the movable ramp most often requires storage space either for appearance sake or for its protection; and it requires manual effort to place it: effort that is often impossible for a disabled person to make. Then too, cold, snowy or rainy weather can also present placement problems for the user of the movable ramp.

In view of the foregoing there is need for a compact ramp that is unseen, adaptable to a variety of locations, and is easily and safely used.

Applicant is aware of the following U.S. patents:

U.S. Pat. No. 4,081,091 to Thorley
U.S. Pat. No. 4,457,402 to Del Vecchio et al.
U.S. Pat. No. 4,479,753 to Thorley
U.S. Pat. No. 4,628,561 to Kushniryk
U.S. Pat. No. 4,929,018 to Carty
U.S. Pat. No. 5,137,114 to Yde et al.
U.S. Pat. No. 5,244,335 to Johns
U.S. Pat. No. 5,312,149 to Boone
U.S. Pat. No. 5,803,523 to Clark et al.
U.S. Pat. No. 5,813,071 to Breslin et al.
U.S. Pat. No. 6,109,854 to Thompson, Jr. et al.
U.S. Pat. No. 6,345,950 to Gerwitz
U.S. Pat. No. 6,484,344 to Cooper

BRIEF SUMMARY OF THE INVENTION

In reference to the two aforementioned ramp types, a third type, the telescoping ramp, is provided. The telescoping ramp assembly includes up to four wheeled sections that nest inside each other and sit, and retract and extend on a metal grid pad. Each ramp section is linked to the fore and aft section with a grab and claw assembly and has an attached pull-up/fold-down railing assembly that moves up and down as the ramp sections move in and out.

The telescoping ramp assembly is attached to a box-like porch which itself is fixed to the entranceway of a home or business. The porch serves both as the door and ramp landings as well as the housing for the nested telescoping ramp sections. The porch also has a swinging door with a set of steps attached that opens and closes as the ramp assembly moves in and out from under the porch.

The telescoping ramp assembly is powered in and out from under the porch either: manually by way of a handle; or by way of an electric motor fixed to (1) an axle/wheel assembly, or (2) a cable/pulley/drum assembly.

The advantages of this telescoping ramp are: it is stored under the porch hiding it from sight and the weather; it takes up less space than a permanent ramp when it is not in use; it is pre-built so no one need hire carpenters for its construction; it is built with attractiveness and low maintenance in mind; it complies with OSHA standards; it is adaptable to a variety of locations; and it is easily installed and relocated.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE SEVERAL VIEWS OF THE DRAWING(S)

The preceding aspects and many of the advantages of this invention will become clearly understood by referring to the following detailed description when taken into consideration with the accompanying drawings.

DETAILED DESCRIPTION OF THE INVENTION

Figure 1:
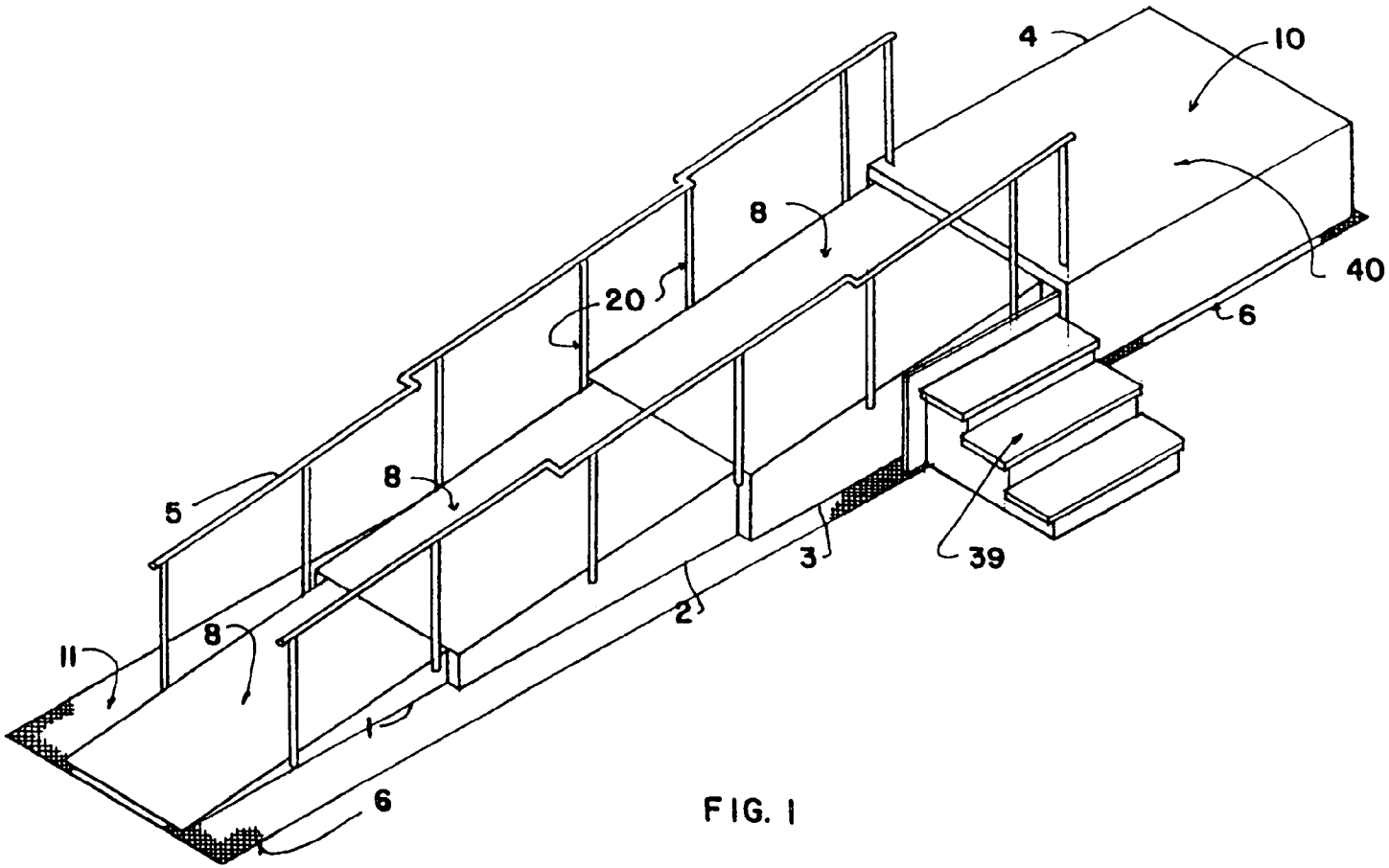
FIG. 1 is a perspective view of the telescoping ramp assembly shown in a fully extended position.
Figure 42:
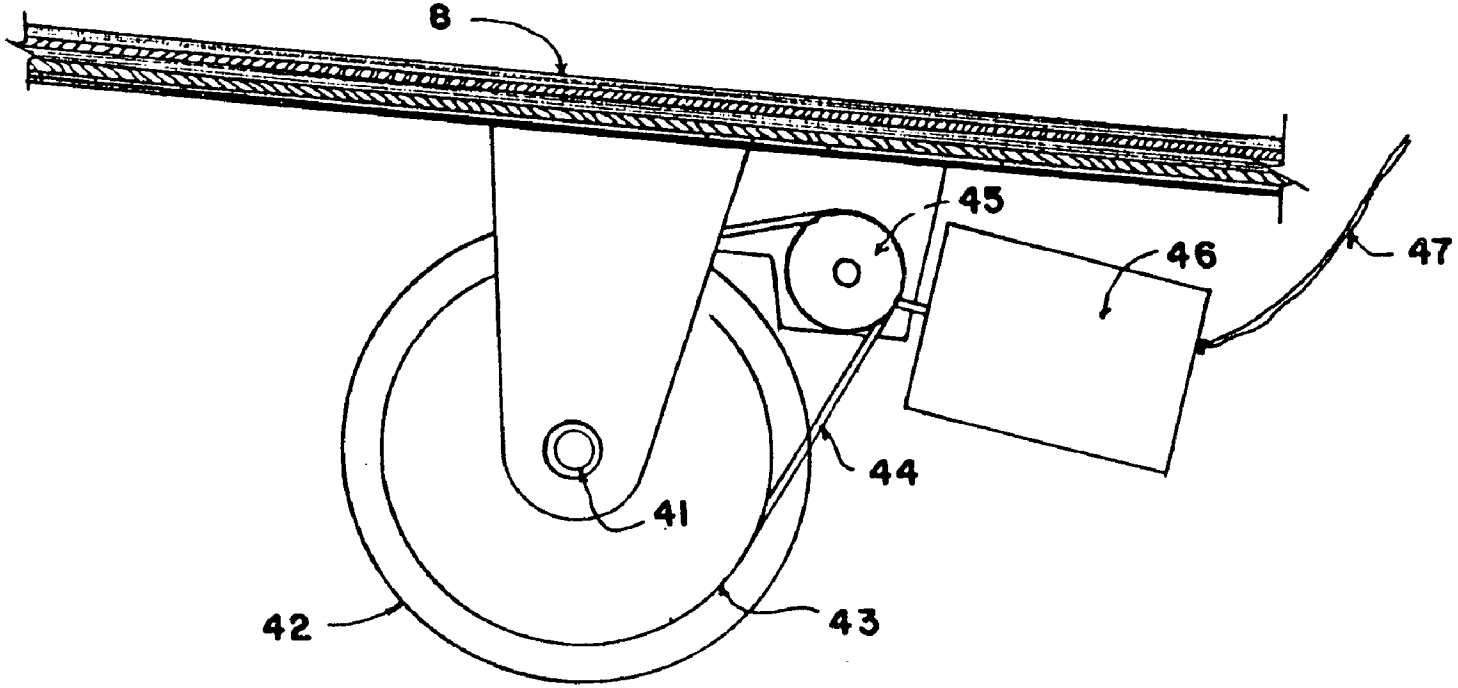
FIG. 42 is a side planar view of the motorized wheel/axle assembly showing the drive axle; the drive wheels; the drive sprocket; the drive chain, the motor sprocket; the motor; and the extension cord.
Figure 44:
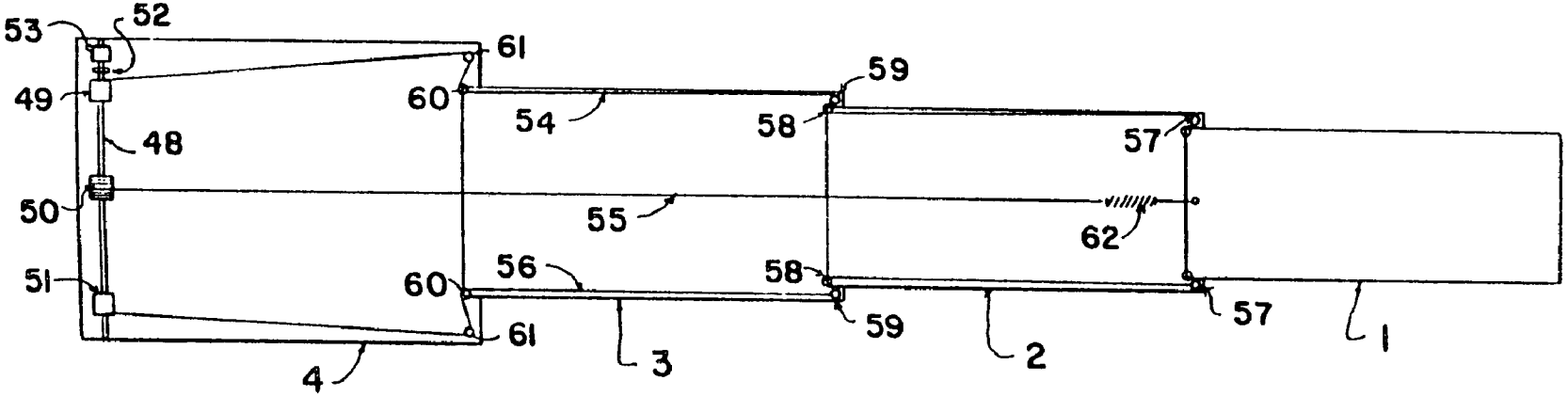
FIG. 44 is a top planer view showing the fully extended telescoping ramp assembly incorporating the extended cable/pulley/drum assembly.
Figure 45:
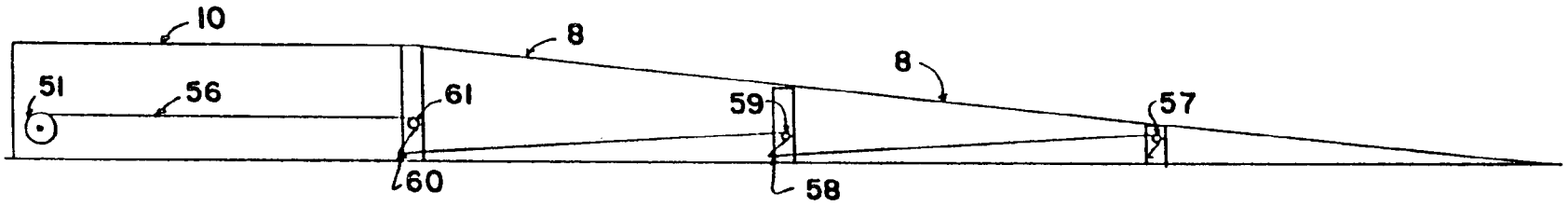
FIG. 45 is a side planar view showing the fully extended telescoping ramp assembly incorporating the extended cable/pulley/drum assembly.

Now with more particular reference to the drawings, shown is FIG. 1, which illustrates an embodiment of the telescoping ramp assembly, (herewith known as ramp assembly). The ramp assembly (shown in FIG. 1) includes: one to four ramp sections (three shown) 1, 2, 3; a housing porch assembly 4; a hand railing assembly 5; a runway assembly 6; and three drive assemblies (not shown) (see FIGS. 42, 44, and 47).

Figure 2:
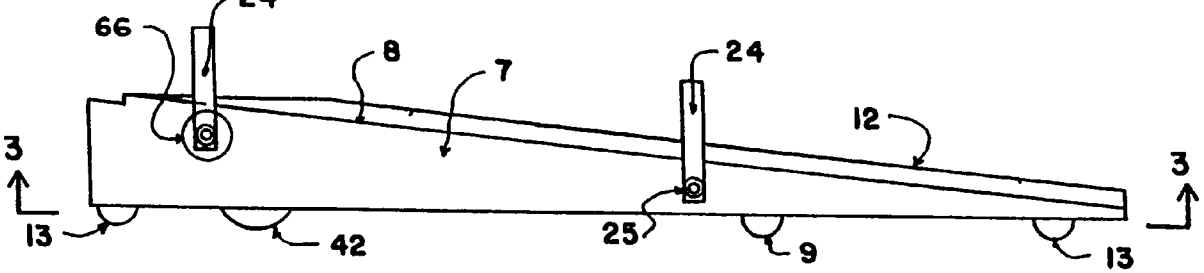
FIG. 2 is a side planar view of the lowest ramp section showing the railing post base fittings; the side curbs; the ramp guide wheels; and the transporting system, which consists of the wheels and drive wheels.
Figure 4:
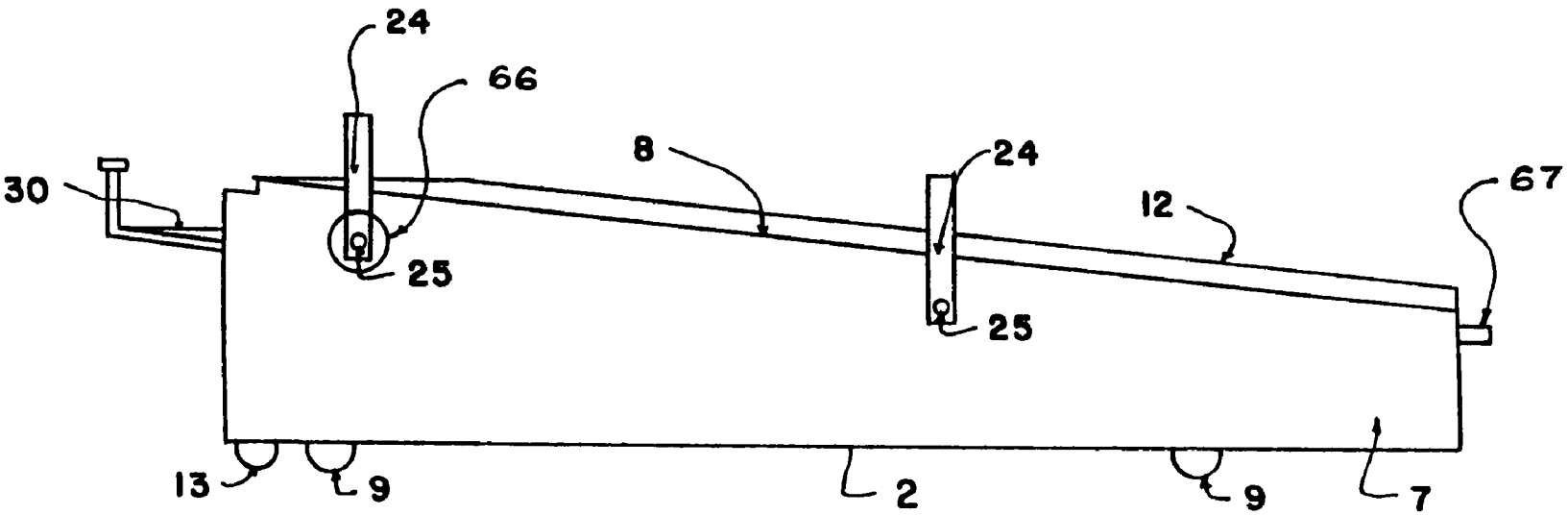
FIG. 4 is a side planar view of the second ramp section showing the railing post base fittings; the curbs; the ramp guide wheel; the claw; and the transporting wheel system.
Figure 5:
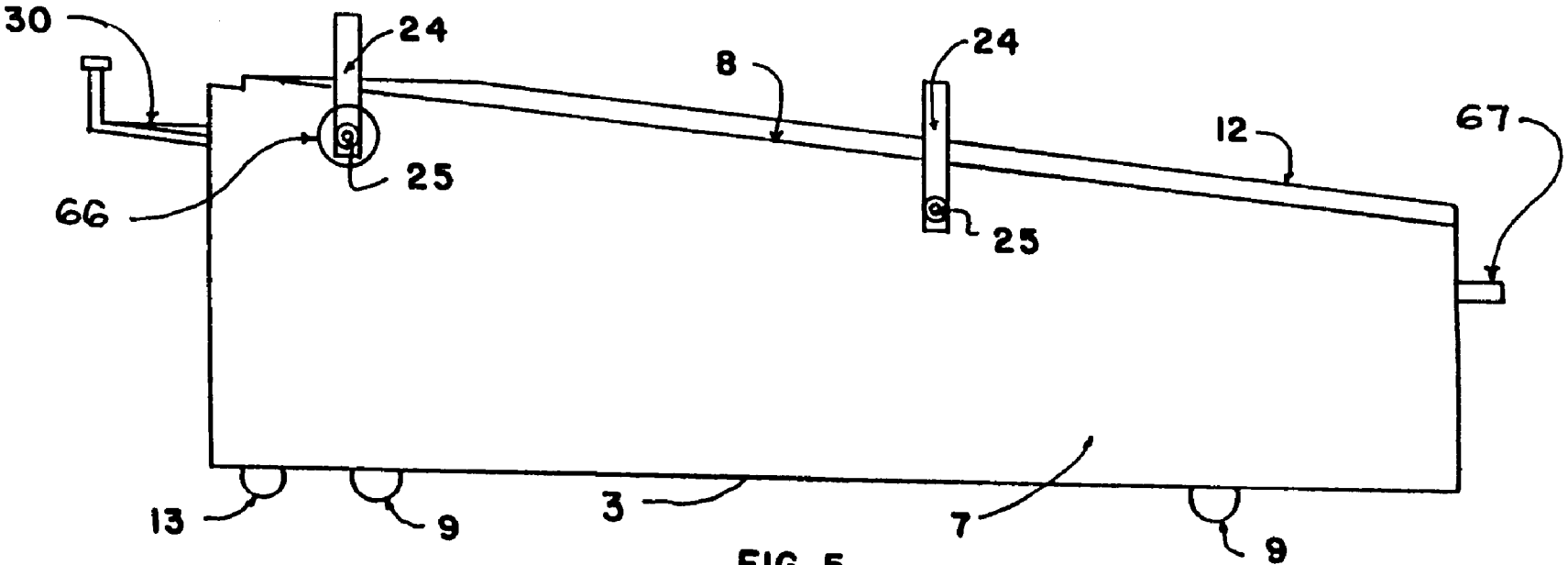
FIG. 5 is a planar side view of the third ramp section showing the railing post base fittings; the curbs; the ramp guide wheel; the claw; and the transporting wheel system.
Figure 9:
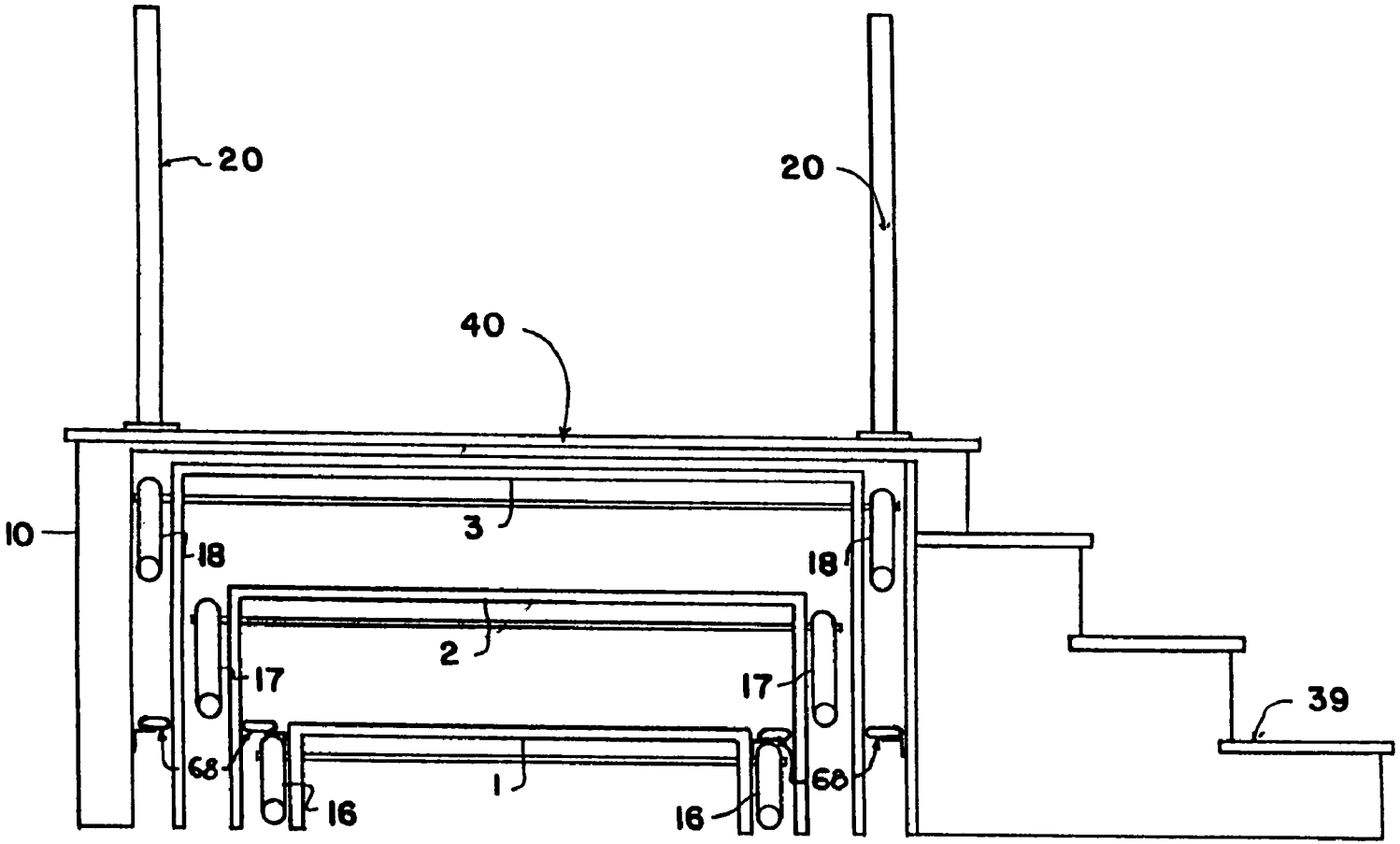
FIG. 9 is a front planar view of the telescoping ramp assembly with the nested ramp sections retracted under the porch, and the swinging door with steps in an open position.
Figure 46:
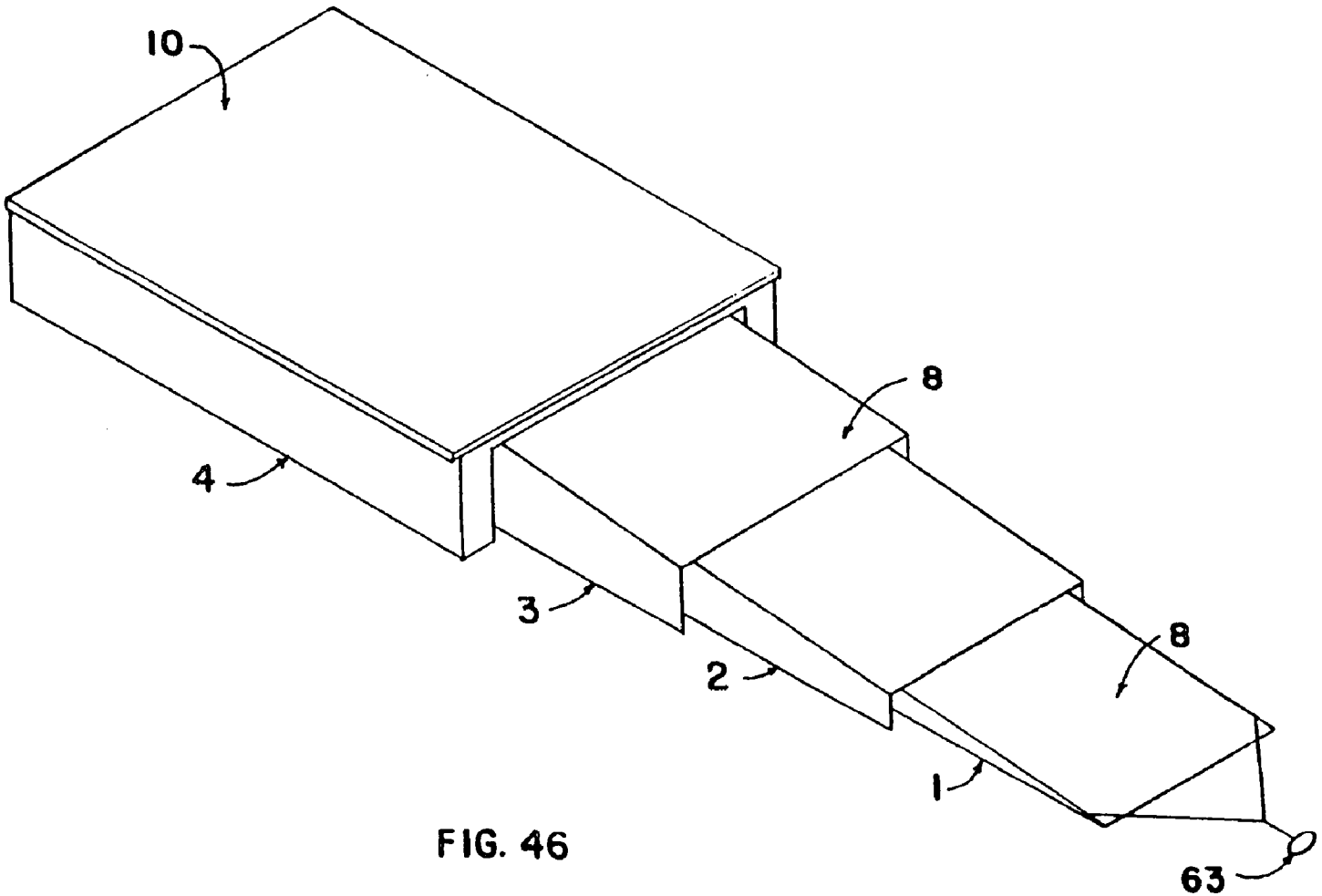
FIG. 46 is a perspective view of the telescoping ramp assembly in a partially extended position incorporating the manually operated fork-like handle.

Each ramp section 1 (shown in FIG. 2), ramp section 2 (shown in FIG. 4) and ramp section 3, (shown in FIG. 5) is trapezoidal in shape 7, with sloping deck 8, mounted on wheels 9, and is constructed of suitable material with deck 8 having a known all-weather non-skid material applied to its surface. Each ramp section (shown in FIG. 46) is adapted to telescope in and out of the fore and aft sections 1, 2, and 3 and porch 10 as it retracts and extends on runway 11 from inside porch 10. And while housed, (shown in FIG. 9) ramp sections 1, 2, and 3 are retracted thus nested inside of each other.

Each ramp section 1 (shown in FIG. 10), ramp section 2 (shown in FIG. 11), and ramp section 3 (shown in FIG. 12) includes side curbs 12 and rail curbs 65. Side curbs 12 extend upward from the sloping walls of each section 1, 2, and 3 and run from the lowest wall point up to the halfway point, then gradually level off with the top of ramp deck 8. Rail curbs 65 stretch between and are mounted to two railing posts 20 directly above post base fitting 24.

Figure 41:
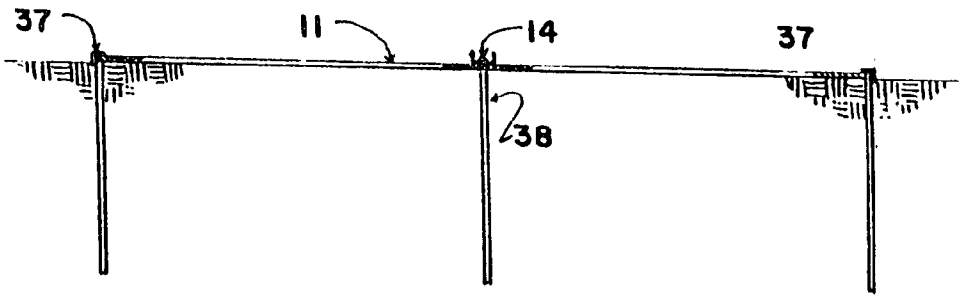
FIG. 41 is the cross section of the metal grid runway with supporting frame and anchor stakes, and centered guide track.

Each ramp section 1 (shown in FIG. 2), ramp section 2 (shown in FIG. 4), and ramp section, (shown in FIG. 5) is constructed to have sprocket guide wheel/wheels 13, that run on cog chain track 14, (shown in FIG. 41), which sits in a channel that runs the full length of runway 11 (shown in FIG. 41). The lowest ramp section 1, (shown in FIG. 3), has two guide wheels 13: one fixed to the under side and center of deck 8 at its lowest point and one fixed to the center point of strut 15 that runs between the two side walls at the bottom rear of ramp 1. Ramp section 2 (shown in FIG. 4) and ramp section 3 (shown in FIG. 5) have only one guide wheel 13 each; both fixed at the center point of strut 15, (shown in FIG. 3) that runs between the side walls at the bottom rear of each ramp section.

Figure 3:
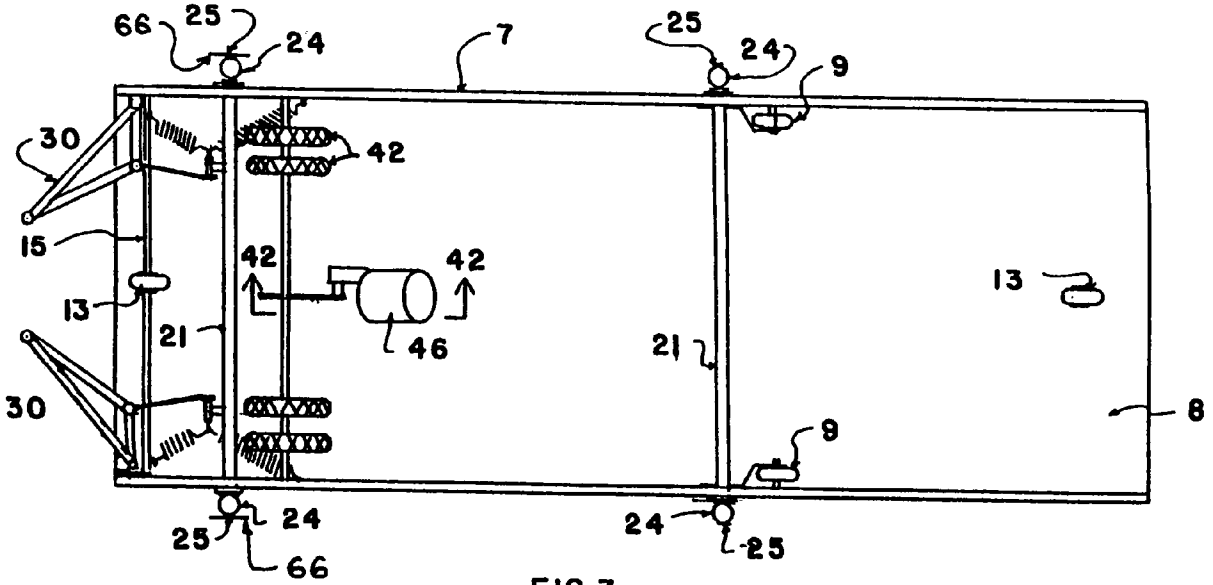
FIG. 3 is the planar view of the underside of the deck of the lowest ramp section showing a detailed plan view of the motorized wheel axle drive assembly; the claw assembly which is a component of the ramp linkage assembly; and the ramp guide wheels.

Each ramp section 1 (shown in FIG. 10), ramp section 2 (shown in FIG. 11) and ramp section 3 (shown in FIG. 12) includes a pair of aluminum pipe pull-up/fold-down railing sections 16, 17, and 18 consisting of handrails 19, posts 20, and rotating axle assemblies 21 (shown in FIG. 3).

Figure 18:
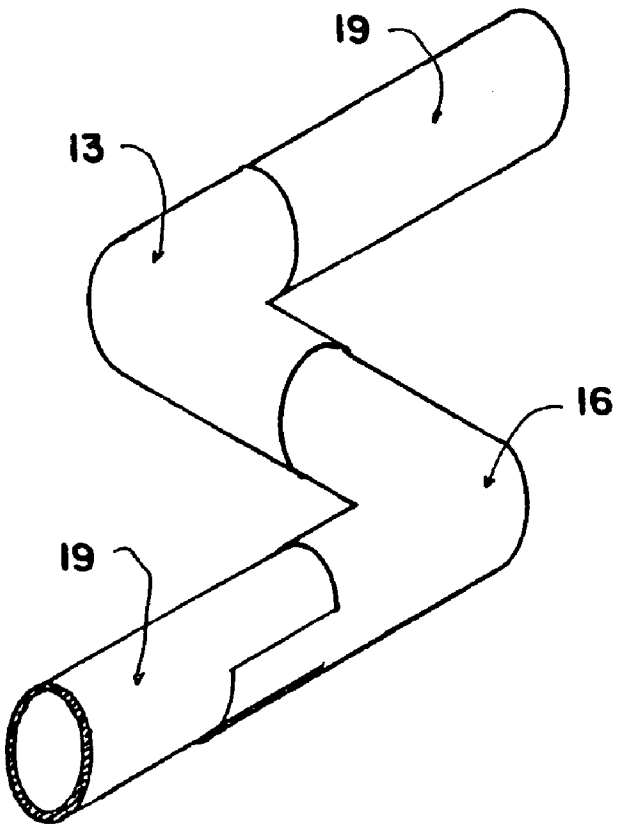
FIG. 18 is a perspective view of two rail connections linked together.
Figure 34:
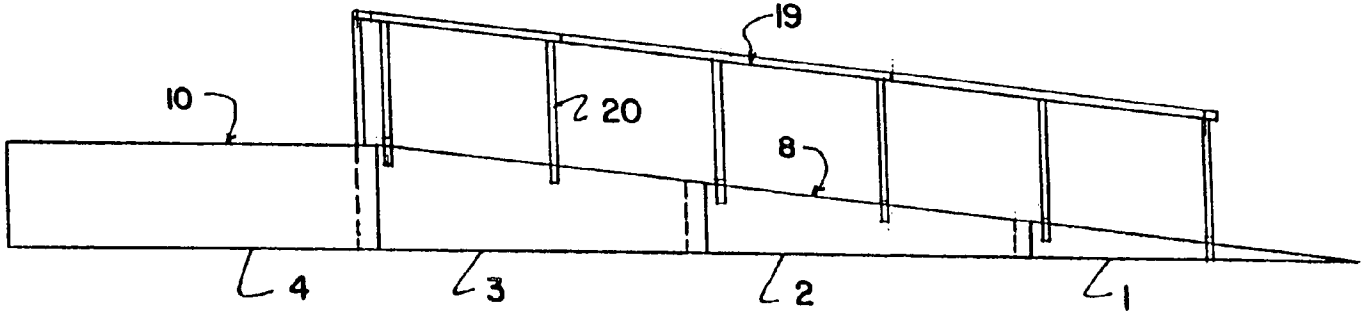
FIG. 34 is a side planar view of the fully extended ramp with railing up.
Figure 36:
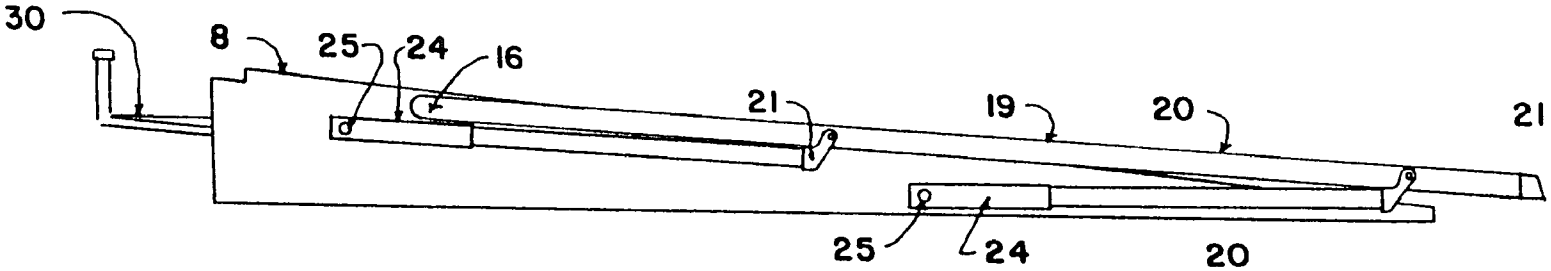
FIG. 36 is the side planar view of the lowest ramp section including the claw; the drive wheel; the transporting system; and the railing assembly in the fold down position.
Figure 37:
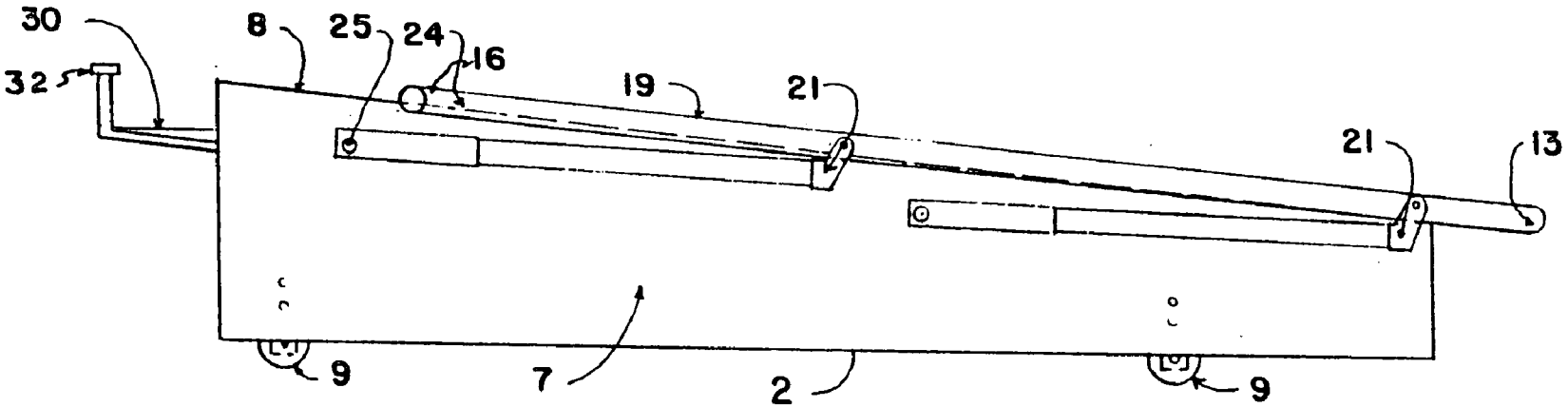
FIG. 37 is the side planar view of ramp section 2 including the claw; the transporting system; and the railing assembly in the fold down position.
Figure 38:
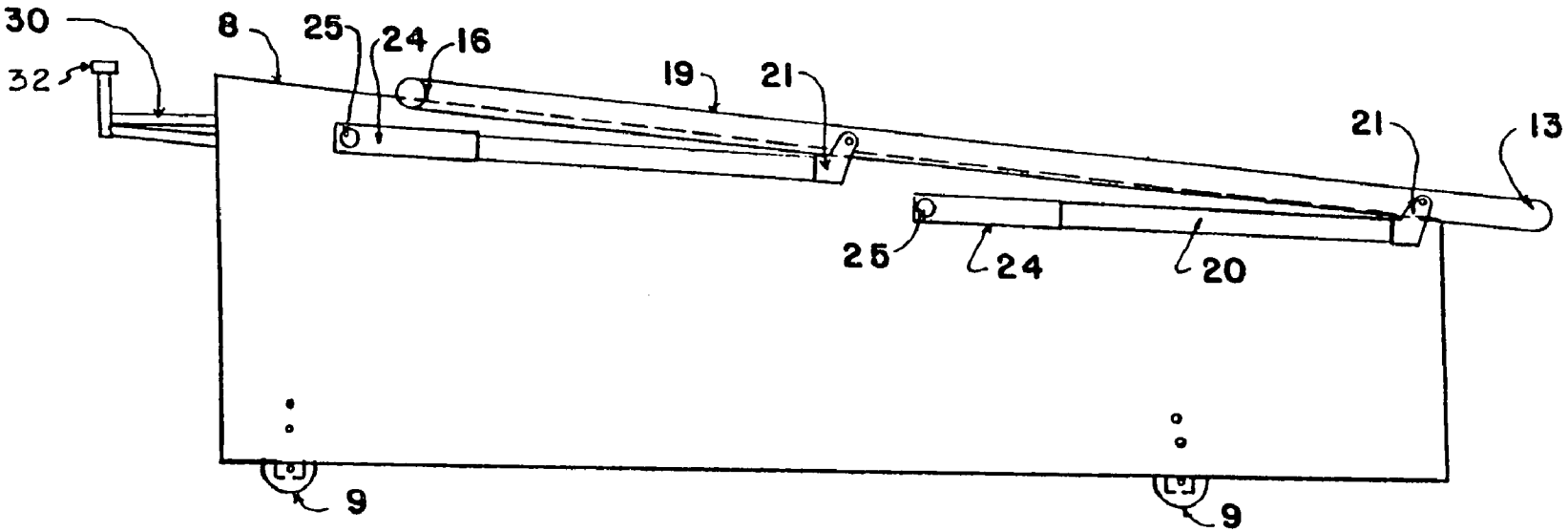
FIG. 38 is the side planar view of ramp section 3 including the claw; the transporting system; and the railing assembly in the fold down position.

Railing sections 16, 17, and 18 rise and lower (section 16 shown in FIG. 36, section 17 shown in FIG. 37, and section 18 shown in FIG. 38) as the hand railings link and unlink (shown in FIG. 18) with handrail 19 (shown in FIGS. 10–12) on the fore and aft ramp sections 1, 2, and 3 as the ramp assembly extends and retracts (shown in FIG. 34).

Figure 13:
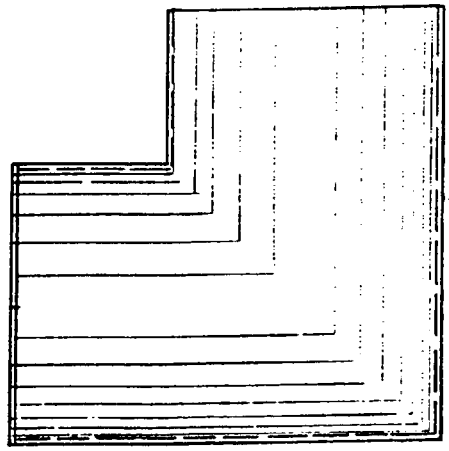
FIG. 13 is a side planar view of the handrail front connection.
Figure 16:
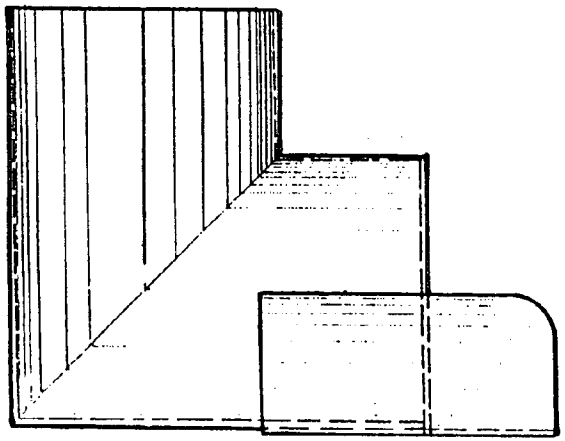
FIG. 16 is a side planar view of the handrail rear connection.

Each handrail 19 (shown in FIG. 18) has two types of handrail connections, which link it to fore and aft ramp railing sections 16,17,18. Both handrail connections are L-shaped: one (shown in FIG. 13) fitting the front end of each handrail section 19 and the other (shown in FIG. 16) fitting the back end of each handrail section 19.

Figure 14:
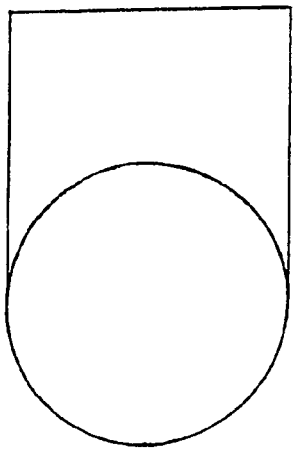
FIG. 14 is a top planar view of the handrail front connection.

The front hand railing connection (shown in FIG. 13) tight fits onto the front end of each handrail section 19 while the other end of this L-shaped handrail connection (shown in FIG. 14) is capped.

Figure 17:
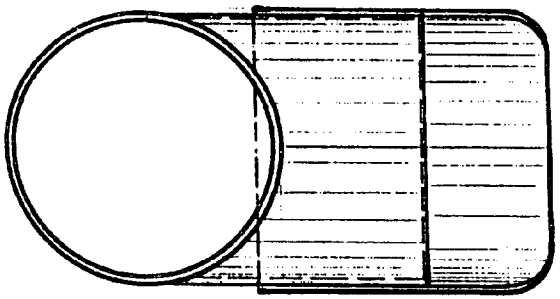
FIG. 17 is a top planar view of the handrail rear connection

The rear handrail connection (shown in FIG. 16) tight fits onto the back end of each handrail section 19 while the other end of this L-shaped hand railing connection (shown in FIG. 17) is cupped in shape. As hand railing 16,17,18 rises this cupped hand railing connection (shown in FIG. 17) slips under and partially around the capped handrail connection (shown in FIG. 16) on the front of the railing section which sits on the ramp section immediately behind. Thus these handrail connections (shown in FIGS. 13 and 16) become a closure (shown in FIG. 18) resulting in a continuous railing (shown in FIG. 1) running from the first ramp to the porch when the ramp assembly is in its fully extended position.

Figure 10:
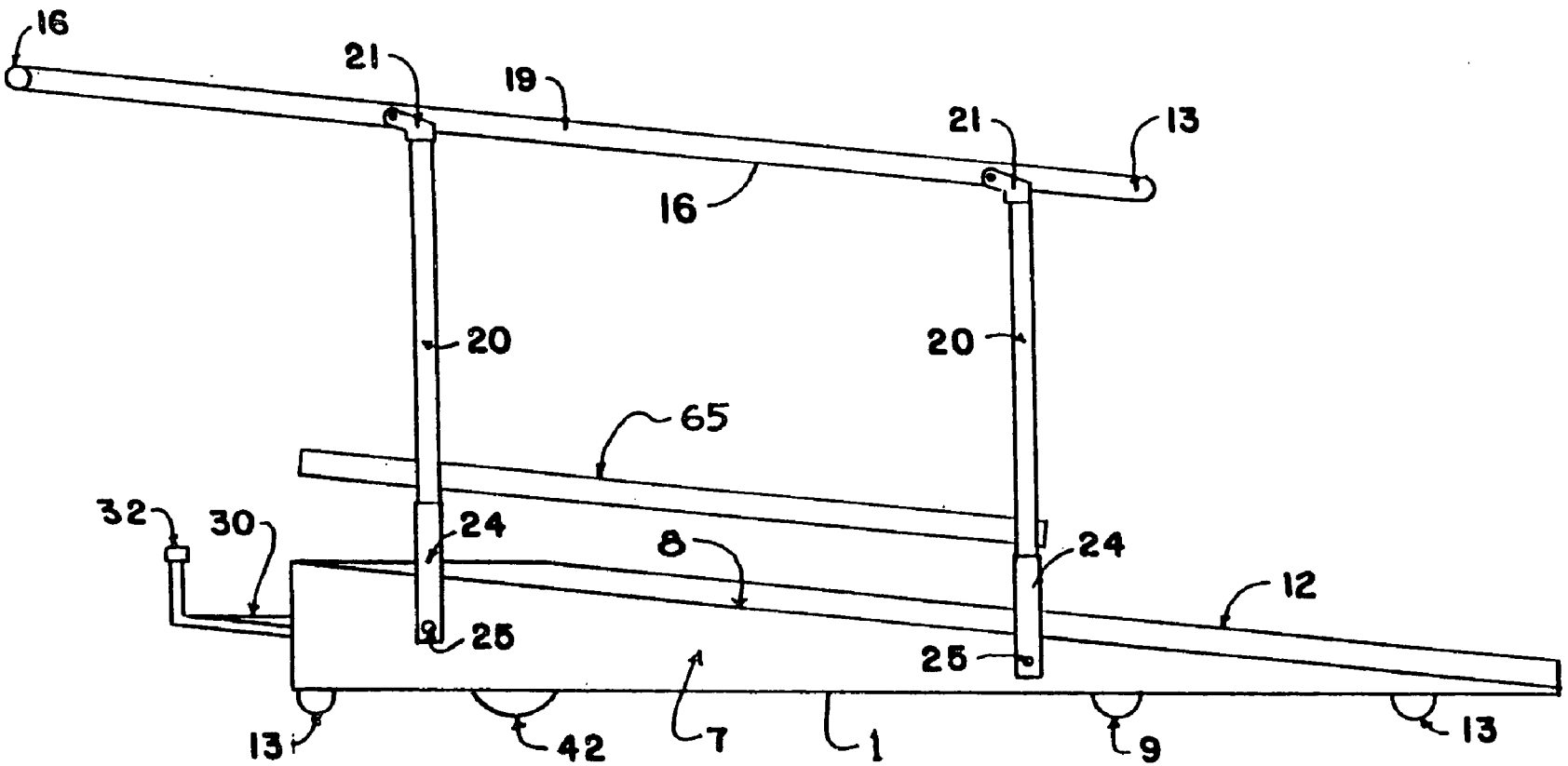
FIG. 10 is a side planar view of the lowest ramp section showing a railing; a curb; transporting wheels; and a claw.
Figure 19:
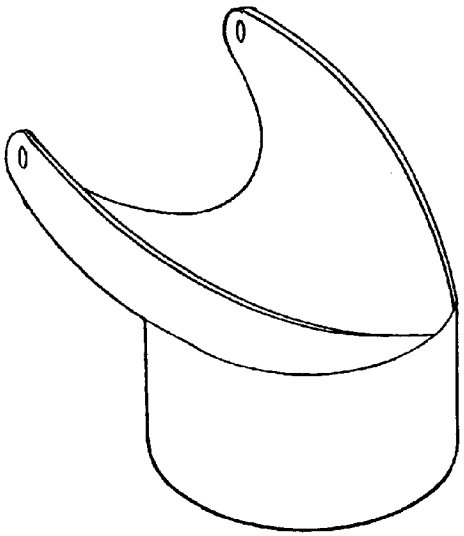
FIG. 19 is a perspective view of the handrail saddle hinge.
Figure 22:
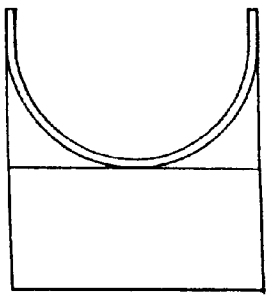
FIG. 22 is an end planar view of the handrail saddle hinge.
Figure 20:
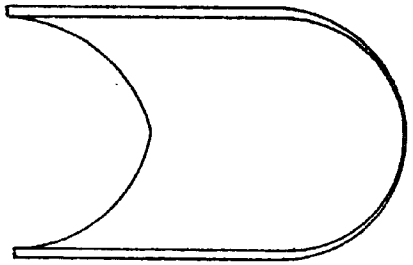
FIG. 20 is a top planar view of the handrail saddle hinge.
Figure 21:
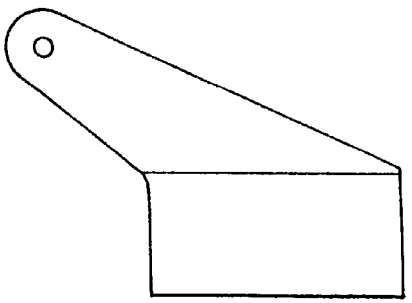
FIG. 21 is a side planar view of the handrail saddle hinge.

Each railing section 16,17,18 includes saddle hinges (shown in FIG. 19), which connect handrail 19 with the top of railing posts 20 (shown in FIG. 10).

Figure 23:
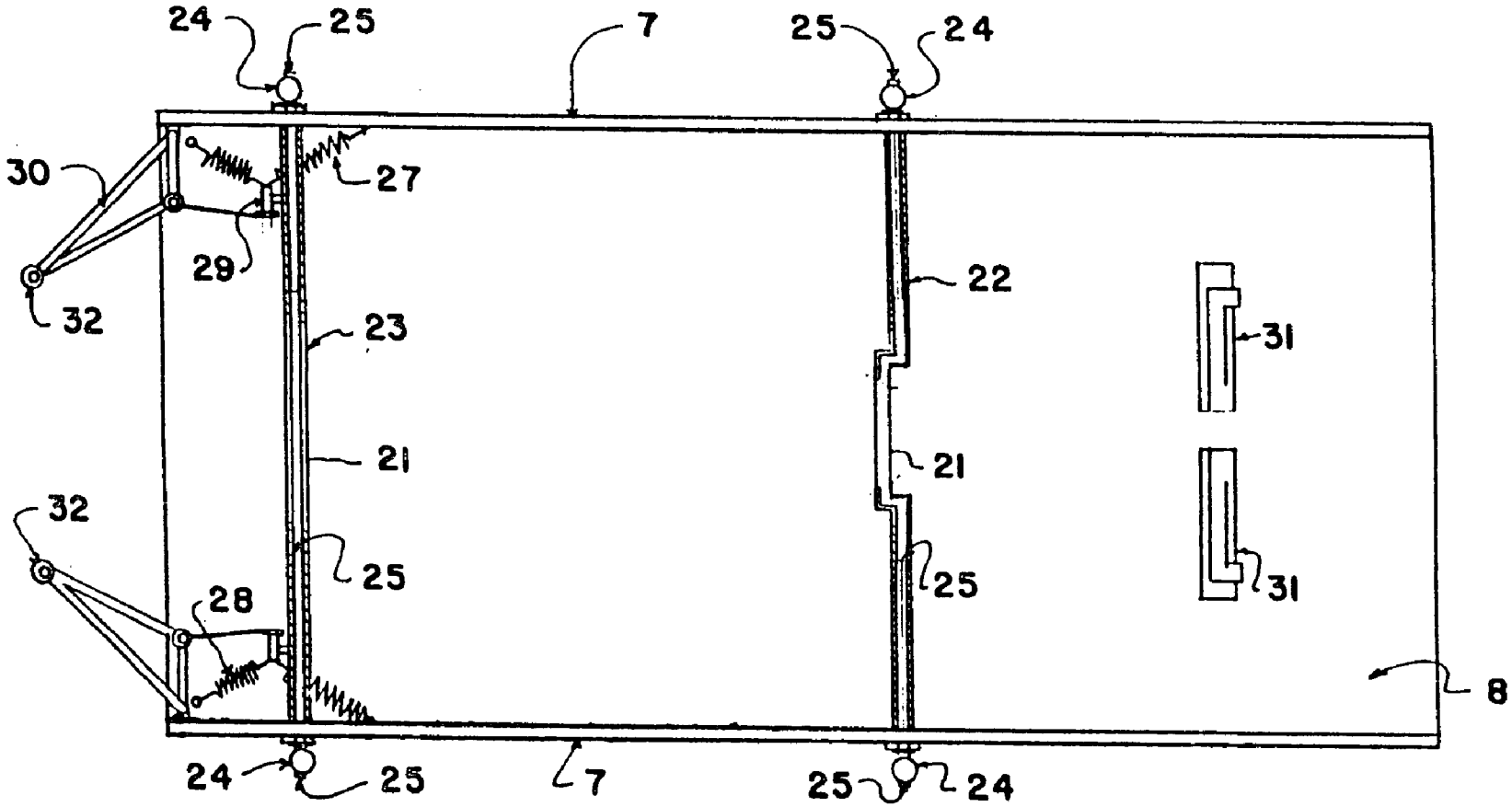
FIG. 23 is a planar view of the axle rod assembly consisting of the drive axle; the idle axle; small horizontal rods; the ball bearing linkages; the tension springs; and the linkage assembly consisting of the claws and the grab bracket.
Figure 24:
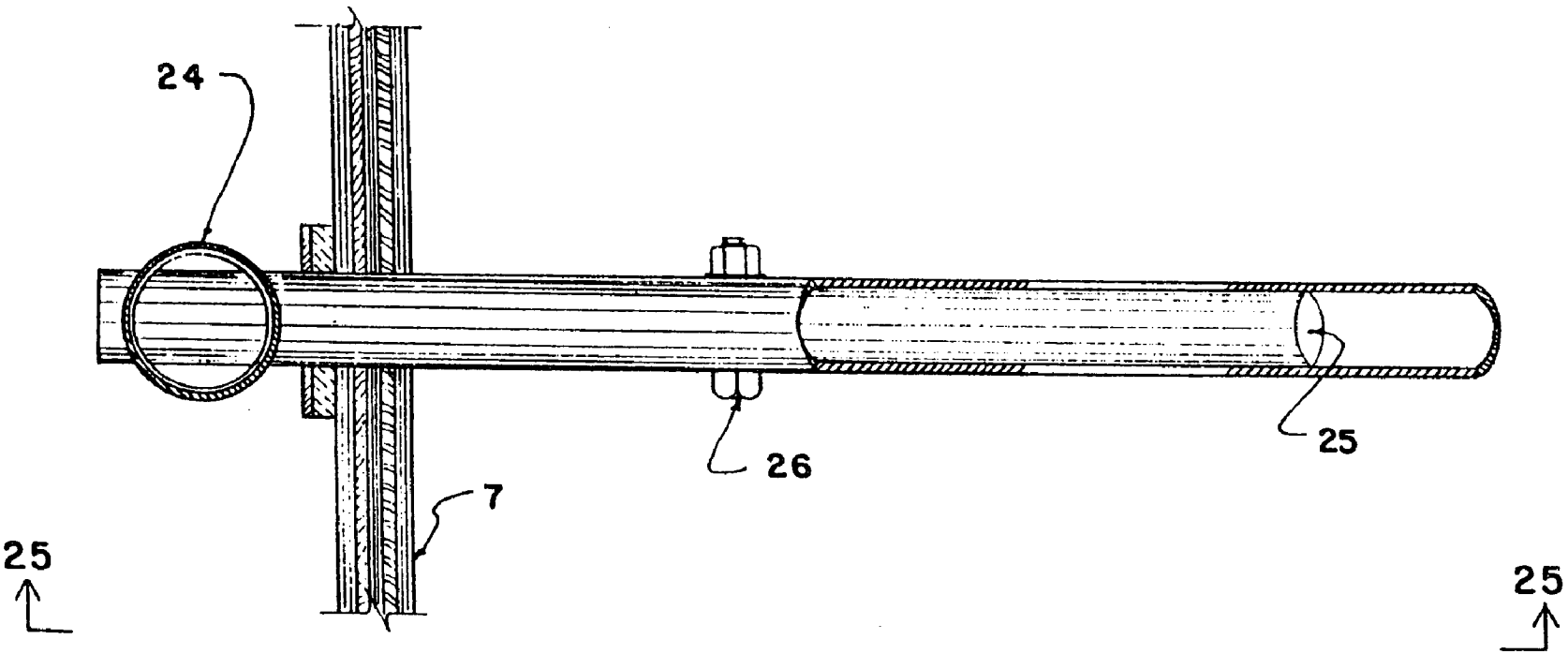
FIG. 24 is a top planar view of a post base fitting with the attached small horizontal rod slipped inside a rotating axle rod.

Each railing section 16,17,18 includes two rotating axle rods (shown in FIG. 23); front idle axle rod 22 running horizontally directly under the center of deck 8 and back drive axle rod 23 running horizontally directly under the rear of deck 8.

Figure 11:
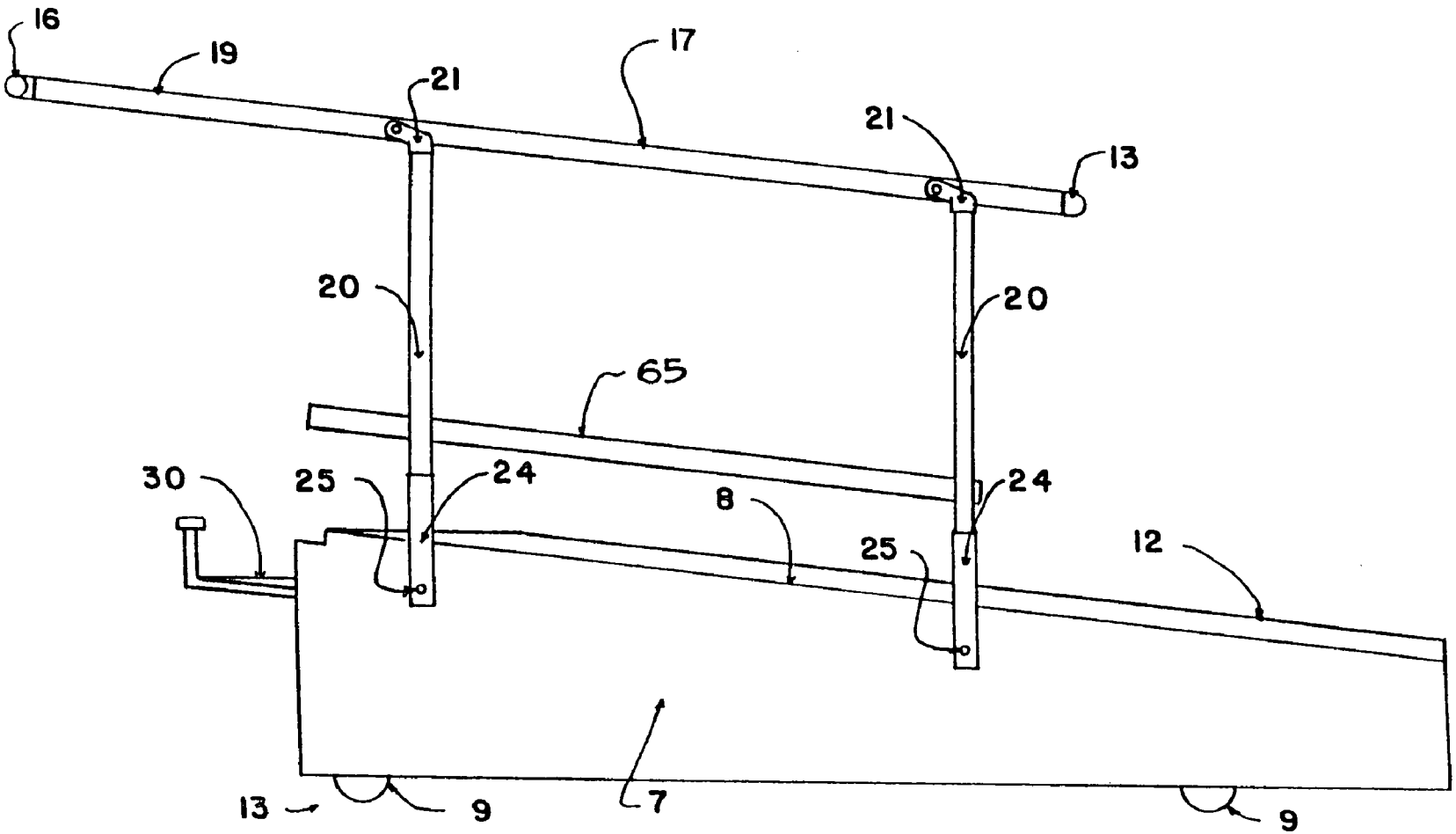
FIG. 11 is a side planar view of the second ramp section showing a railing; a curb; transporting wheels; and a claw.
Figure 12:
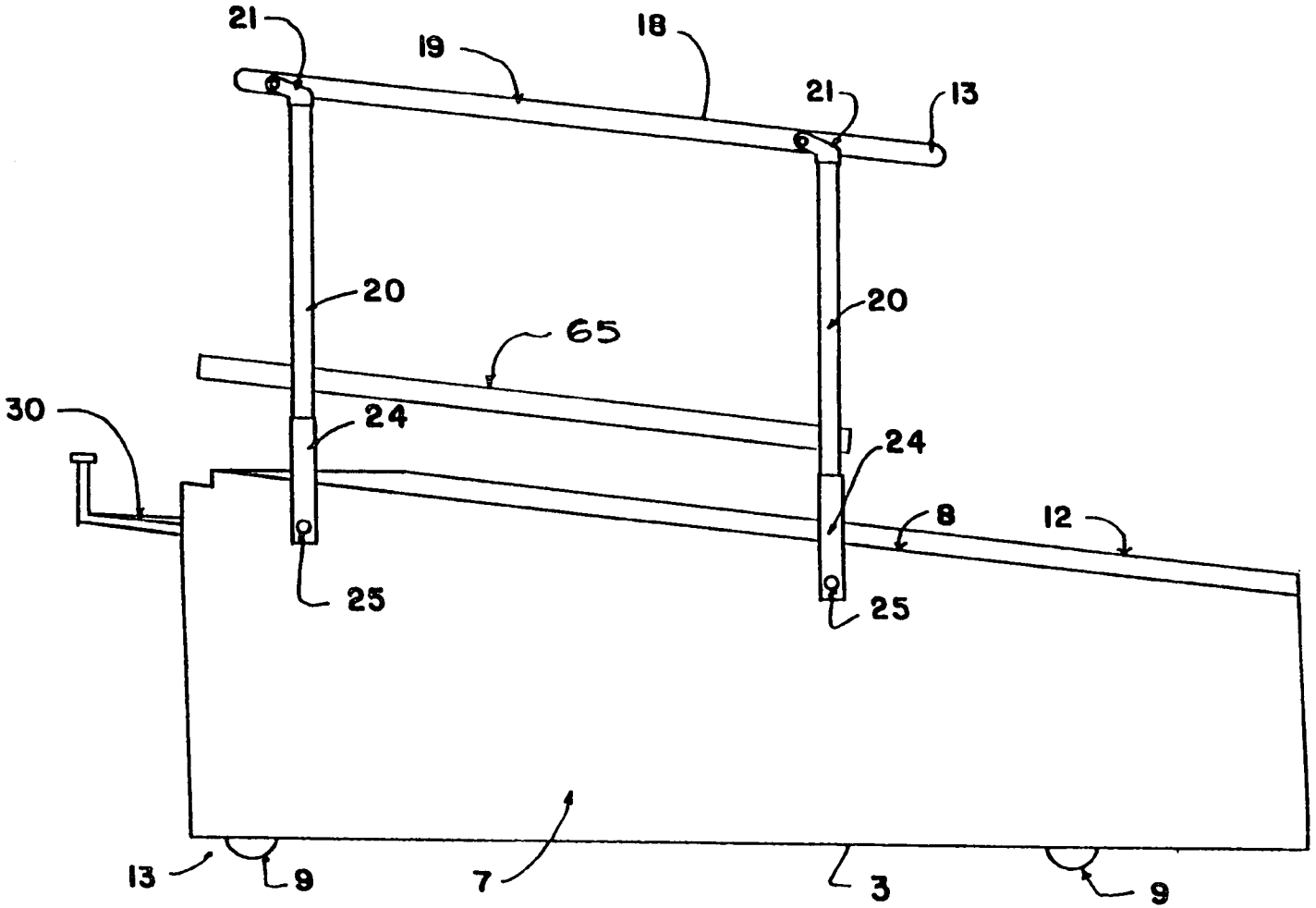
FIG. 12 is a side planar view of the third ramp section showing a railing; a curb; transporting wheels; and a claw.
Figure 15:
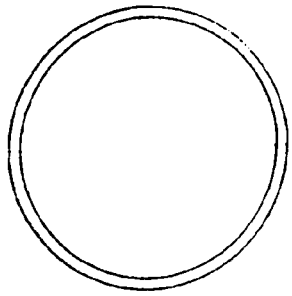
FIG. 15 is an end planar view of the handrail front connection.
Figure 25:
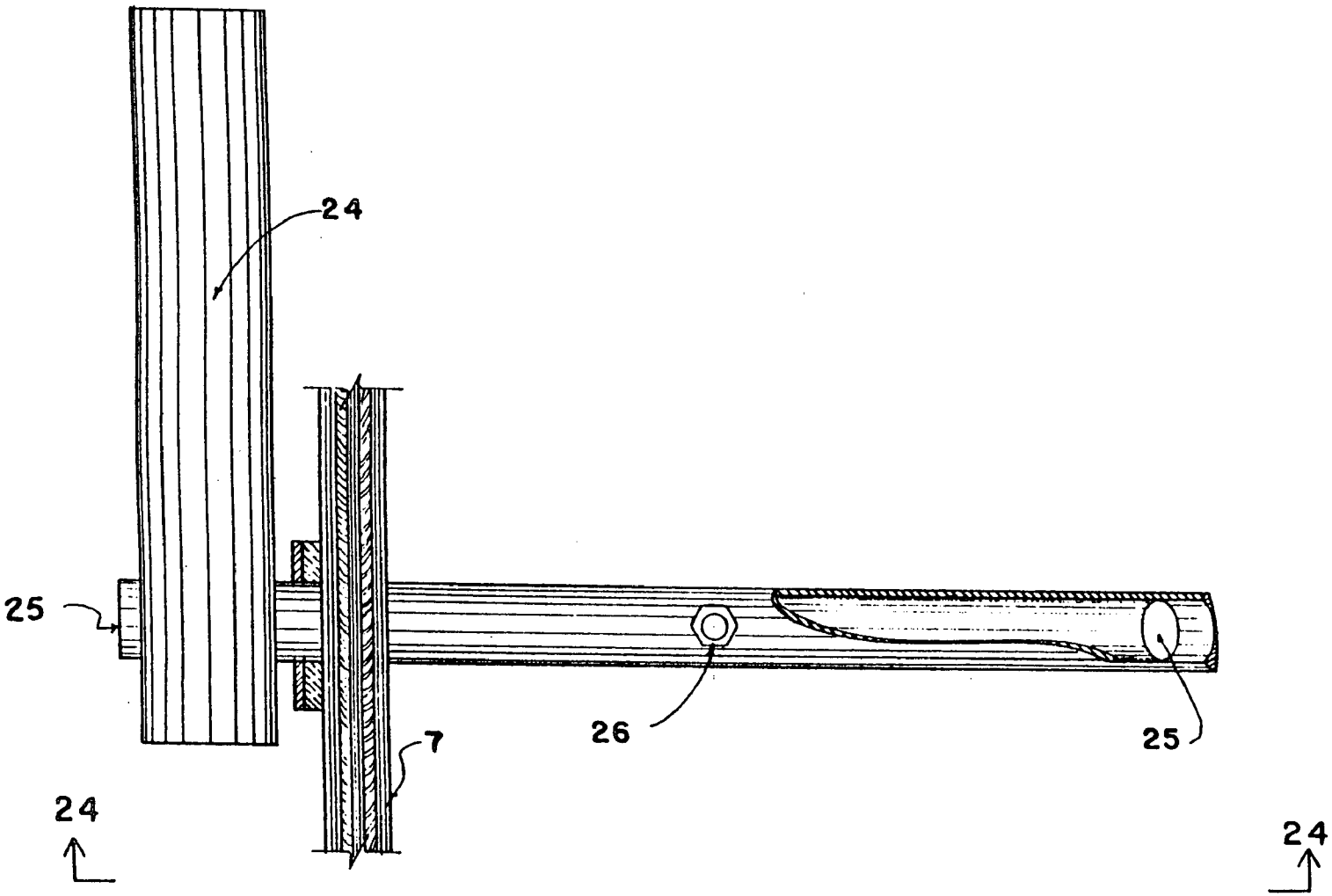
FIG. 25 is a side planar view of a post base fitting with the attached small horizontal rod slipped inside a rotating axle rod.

Each railing section 16,17,18 includes two sets of railing posts 20 (one on each side) which are linked together and sit on the outside walls of each ramp section (shown in FIGS. 10–12). This is done by way of railing post base fitting 24 (shown in FIG. 25) that slips over the bottom of each railing post 20. Fixed onto base fitting 24, is one end of small horizontal rod 25. The other end of small horizontal rod 25 slips inside rotating axle rod 22, 23 which runs through and is flush with the two outside walls of the ramp section (shown in FIG. 23). Small horizontal rod 25 is fixed inside each rotating axle rod 22,23 by way of a bolt and nut 26, thus making rotating axle rod assembly 21 and hand railing 16,17,18 work as one unit.

Figure 26:
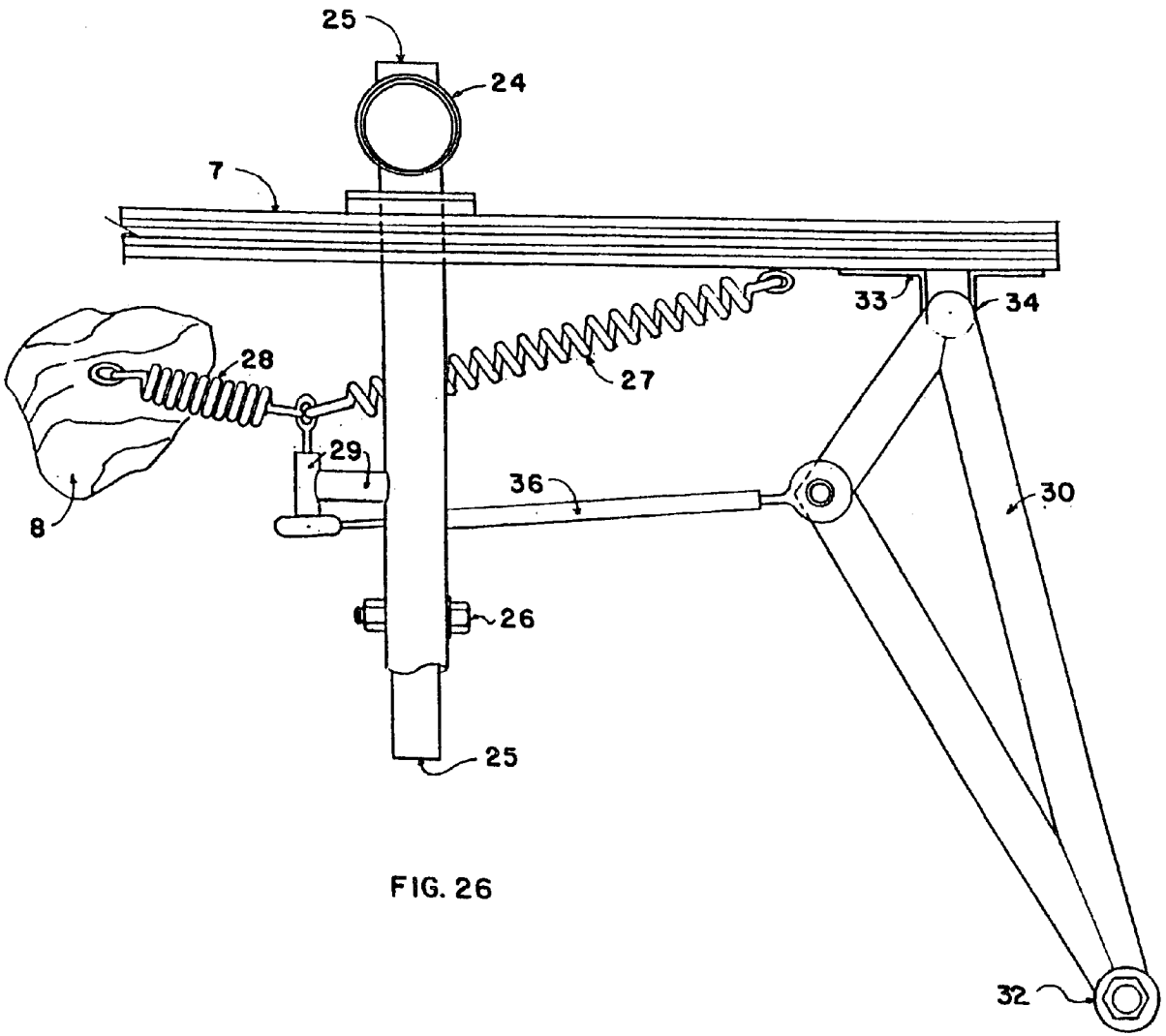
FIG. 26 is a planar view of part of the linkage system, which includes the claw assembly, ball bearing linkage; tension springs attached to small arm; and the drive axle rod.

A tension spring 27 (shown in FIGS. 23 and 26) is attached to small arm 29 on the end of each railing rotating drive axle rod 23 and to the inside of the wall of each ramp. Tension spring 27 aids in the up-lift of the railing section. An opposing resistance spring 28 is also attached to small arm 29 and to the under side of deck 8 to slow down the upward lift.

A linkage assembly (shown in FIG. 23) is located at the front end and back end of each ramp section 1,2,3 and is responsible for actuating railing sections 16,17,18 up and down, and for holding ramp sections 1,2,3 together while the ramp assembly (shown in FIG. 1) is in the extended position.

Figure 28:
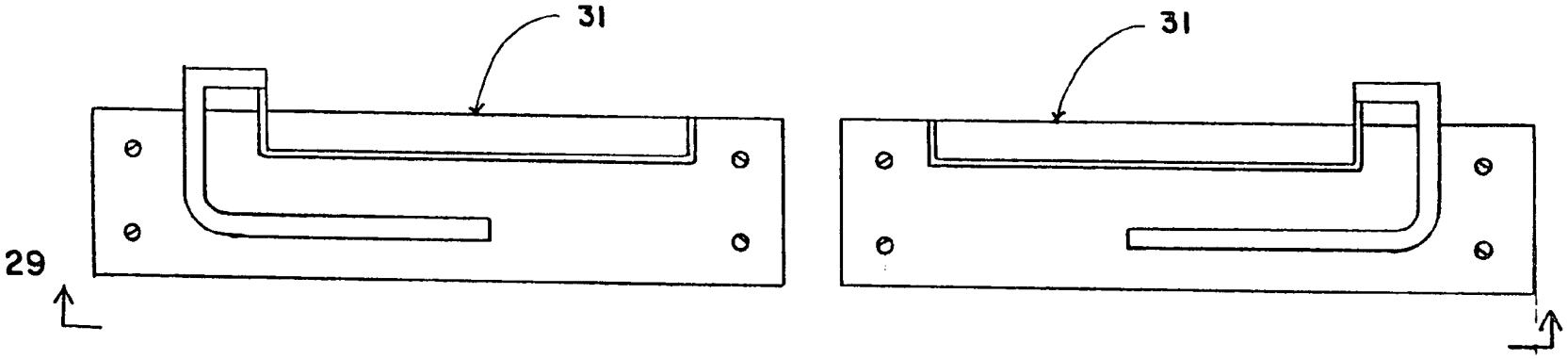
FIG. 28 is a planar view of the grab bracket assembly.
Figure 29:
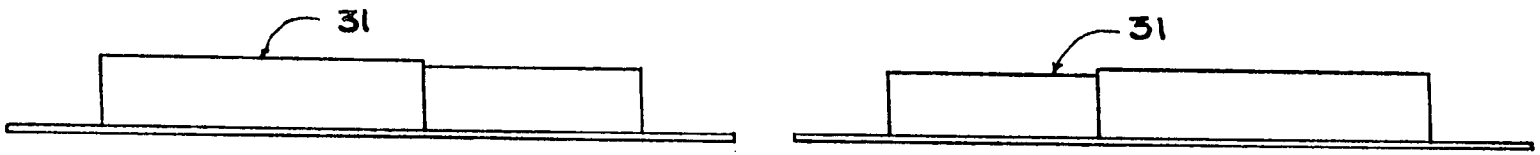
FIG. 29 is a side planar view of the grab bracket assembly.
Figure 30:
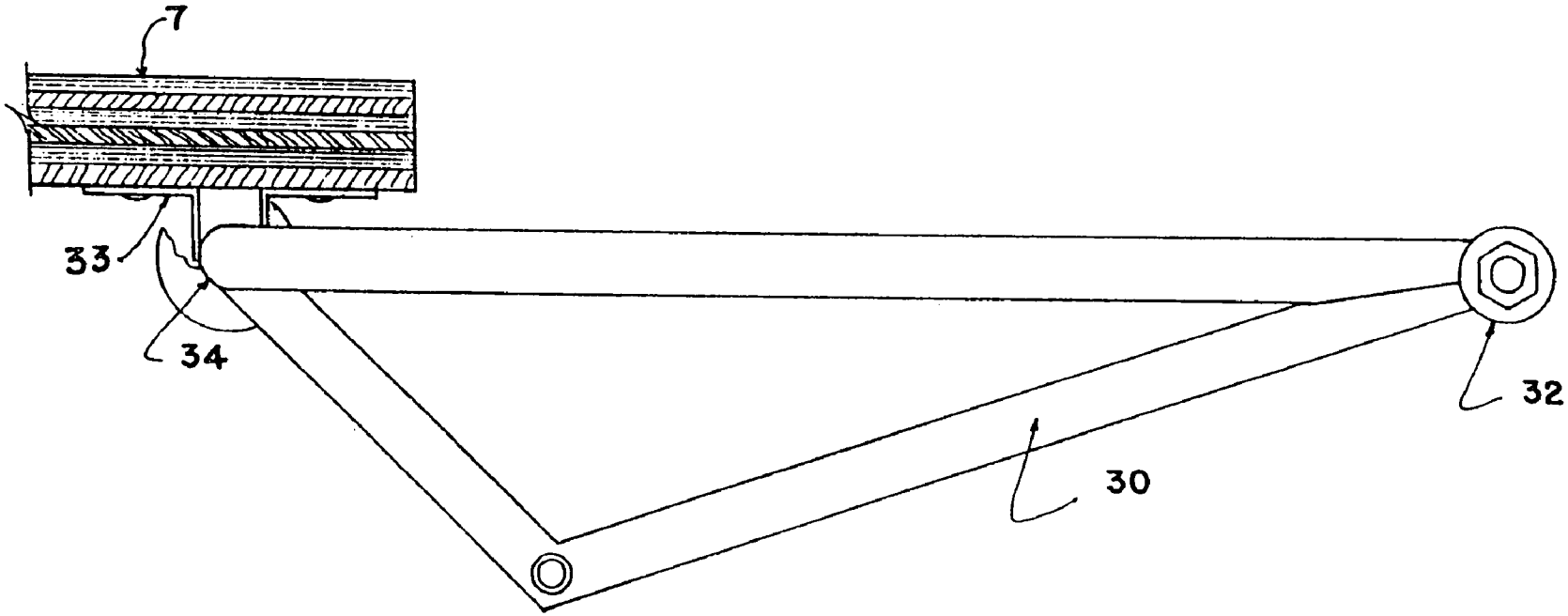
FIG. 30 is a planar view of the claw assembly.
Figure 31:
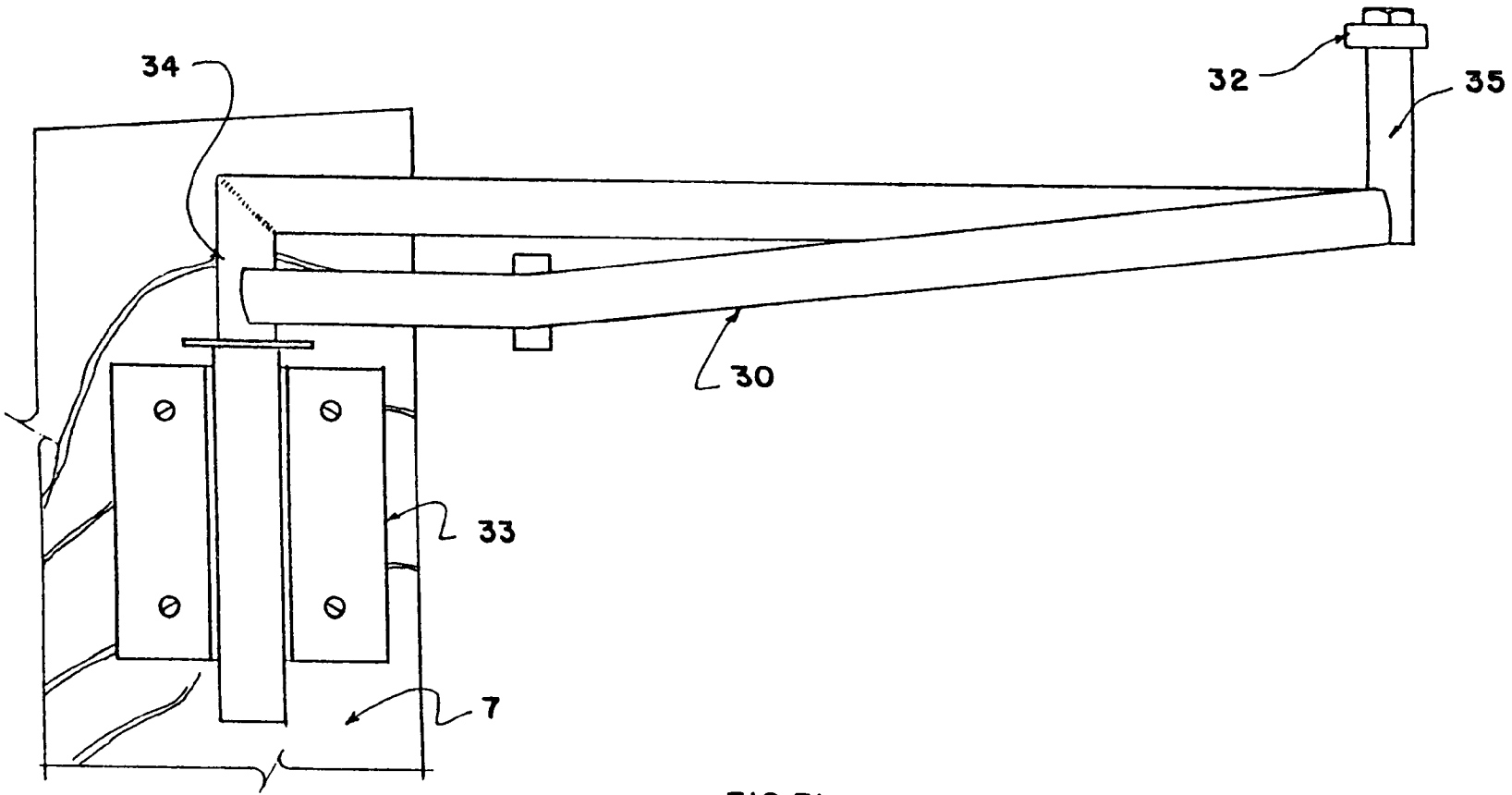
FIG. 31 is a side planar view of the claw assembly.

This linkage assembly (shown in FIG. 26) consists of six claws 30 and six grab brackets 31. A grab bracket assembly (shown in FIG. 23) is fixed to the front center under-side of deck 8 of each ramp section 1,2,3 and consists of two channeled restrainer brackets 31 (shown in FIG. 28) each the mirror image of the other. Each restrainer bracket 31 sits horizontally beside the other with a fixed distance between them and engages with roller bearing wheel 32 on the claw assembly (shown in FIG. 30) attached to ramp section 1,2,3 in front of it.

Figure 27:
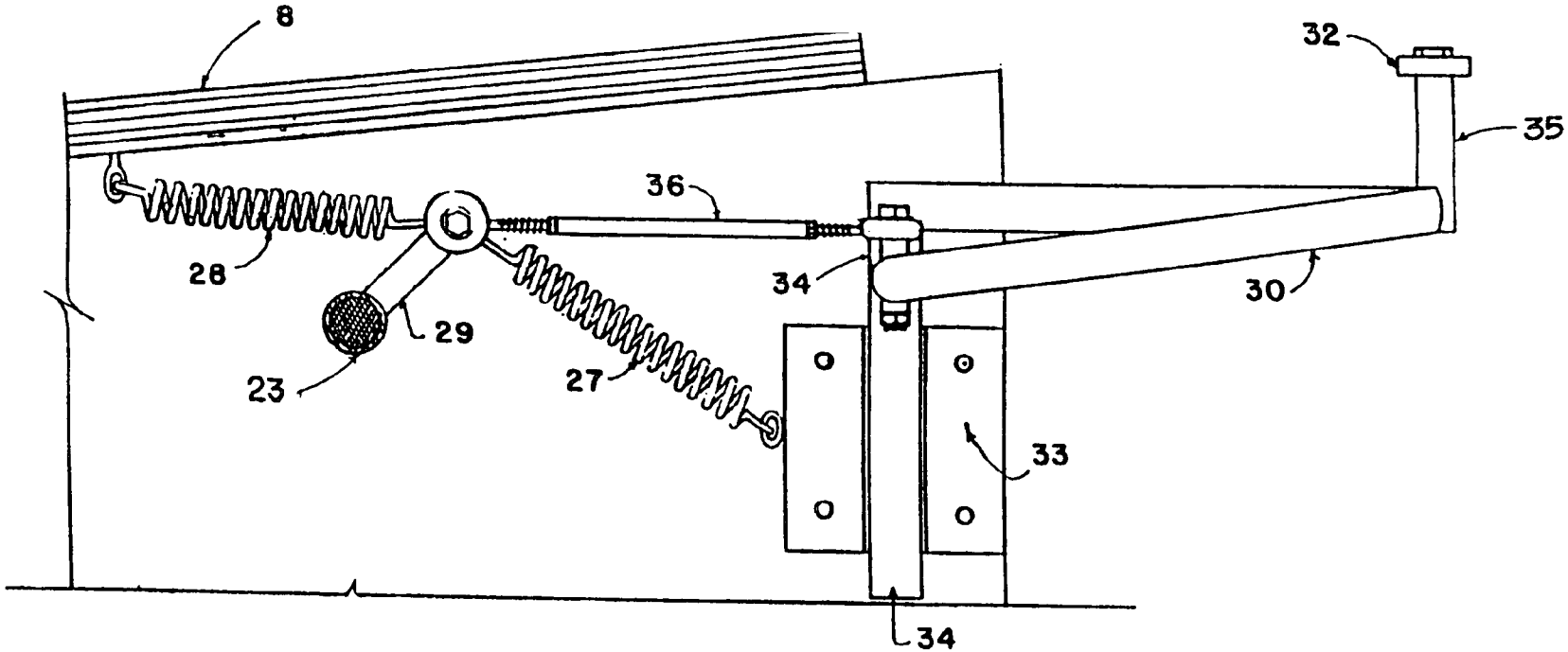
FIG. 27 is a side planar view of part of the linkage system, which includes the claw assembly, ball bearing linkage; tension springs attached to the small arm; and the drive axle rod.

A claw assembly (shown in FIG. 27) is fixed to the rear and top of the two inside walls of each ramp section 1,2,3, by way of angle bracket 33. Claw 30 is attached to angle bracket 33 by way of vertical pin 34. Claw 30 is a horizontal tubular triangle with vertical post 35 with attached roller bearing wheel 32, fixed to the point of its narrowest angle.

The base of each claw 30 is connected to small arm 29 on the end of each railing rotating drive axle rod 23 by way of roller bearing link bar 36.

Figure 32:
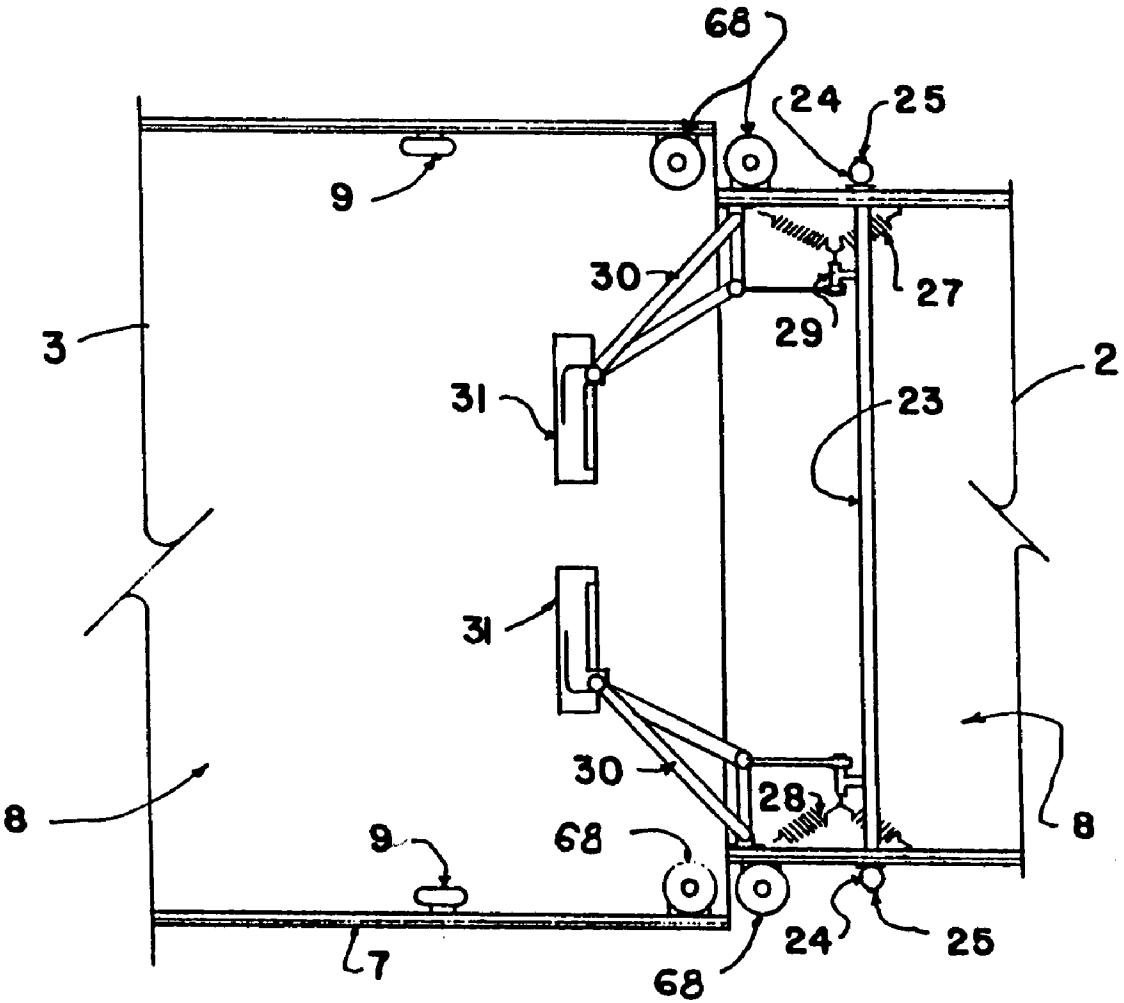
FIG. 32 is a top planar view of the engaged claw and grab bracket linkage assembly.
Figure 33:
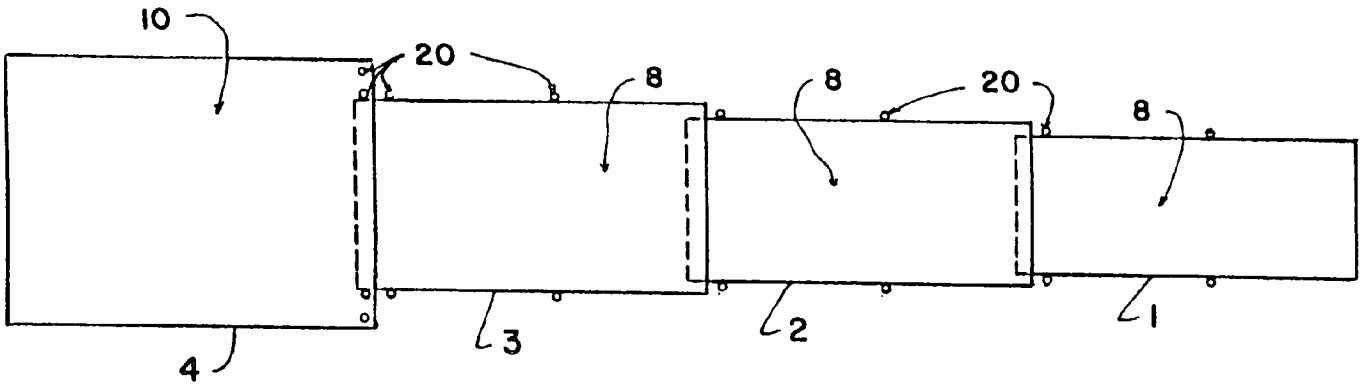
FIG. 33 is a top planar view of the fully extended ramp with railing up.
Figure 35:
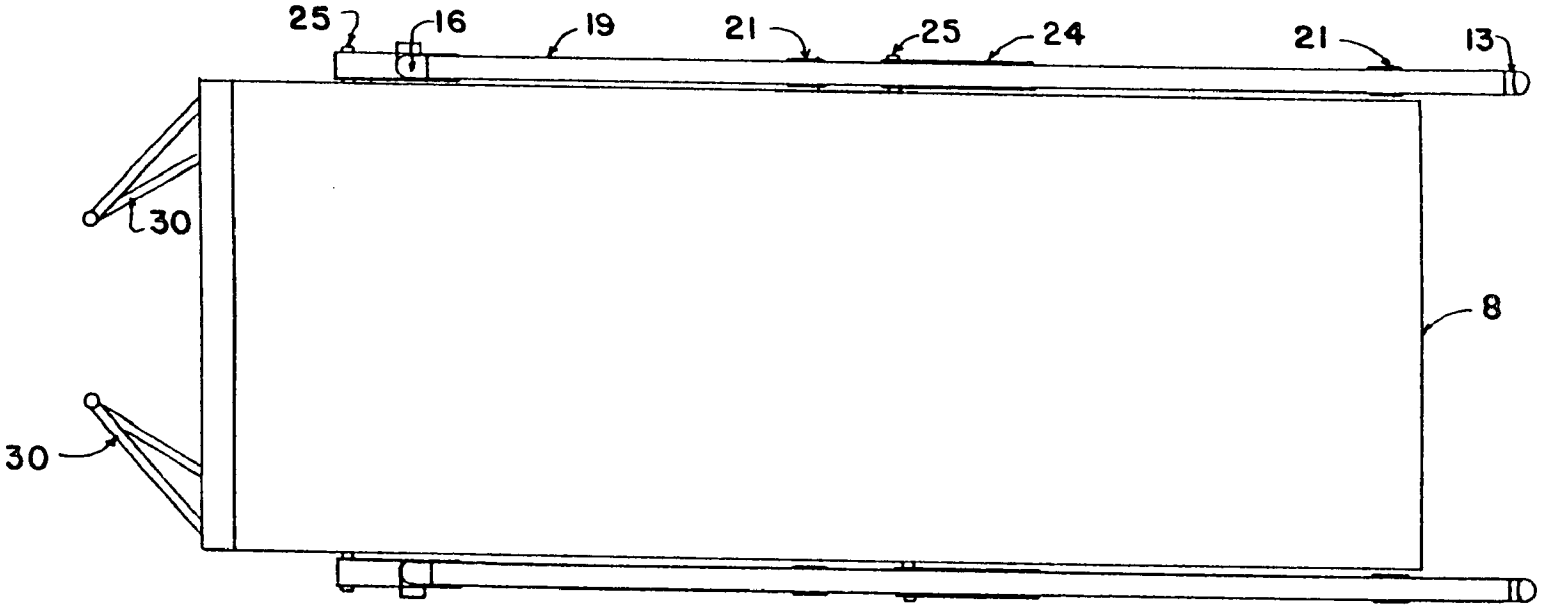
FIG. 35 is a top planar view of a ramp section with the railing in the fold down position.

The linkage assembly (shown in FIG. 32) functions by way of claws 30 and grab brackets 31 engaging as each lower ramp section 1,2,3 moves out from underneath the next higher ramp, causing lower ramp claws 30 to slip/slide into grab bracket 31 on the next larger ramp. This engagement results in the pulling up and locking of railing section 16,17,18 on each ramp 1,2,3 as the ramp assembly (shown in FIG. 1) reaches its nearly completed extended position. Then as the ramp assembly (shown in FIG. 1) retracts, claws 30 and grab brackets 31 disengage thus unlocking and pushing sectional railings 16,17,18 forward into the fold-down position (shown in FIG. 35).

Figure 39:
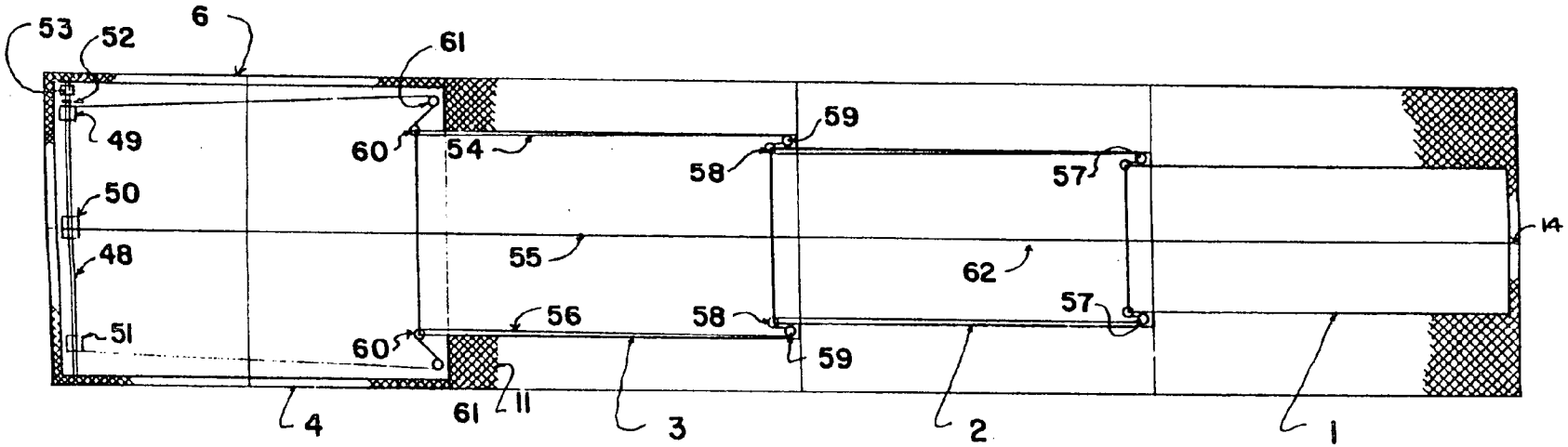
FIG. 39 is the top planar view of the extended telescoping ramp assembly setting on the metal grid runway with the attached guide track.
Figure 40:
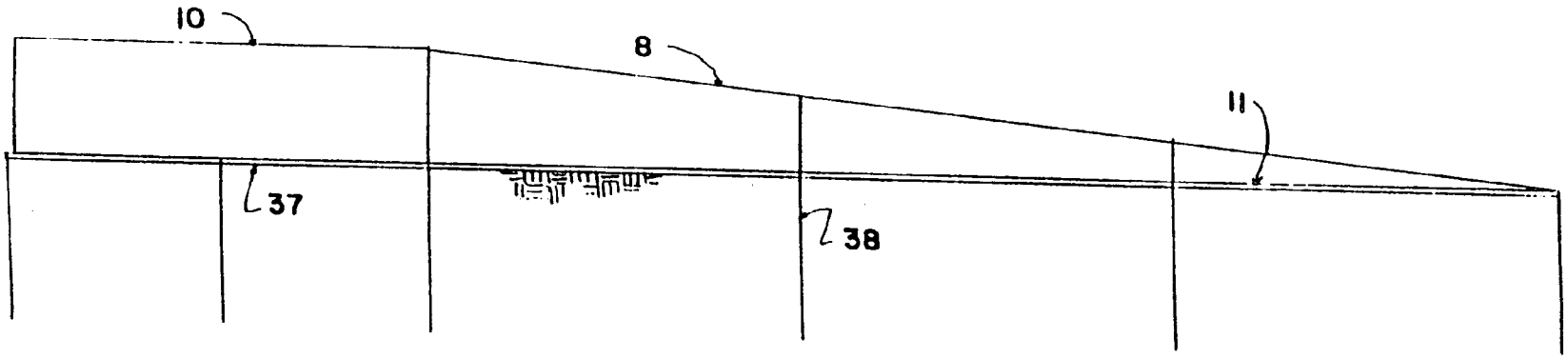
FIG. 40 is the side planar view of the extended telescoping ramp assembly sitting on the metal grid runway with anchor stakes.

Runway 11 (shown in FIG. 39) for the telescoping ramp (shown in FIG. 1) is fabricated of metal deck welded to a steel framework 37 (shown in FIG. 41) and anchored to the earth by way of a steel bolt/stake assembly 38. Runway 11 stretches the full length and width of porch 10 and the extended ramp (shown in FIG. 1).

Figure 6:
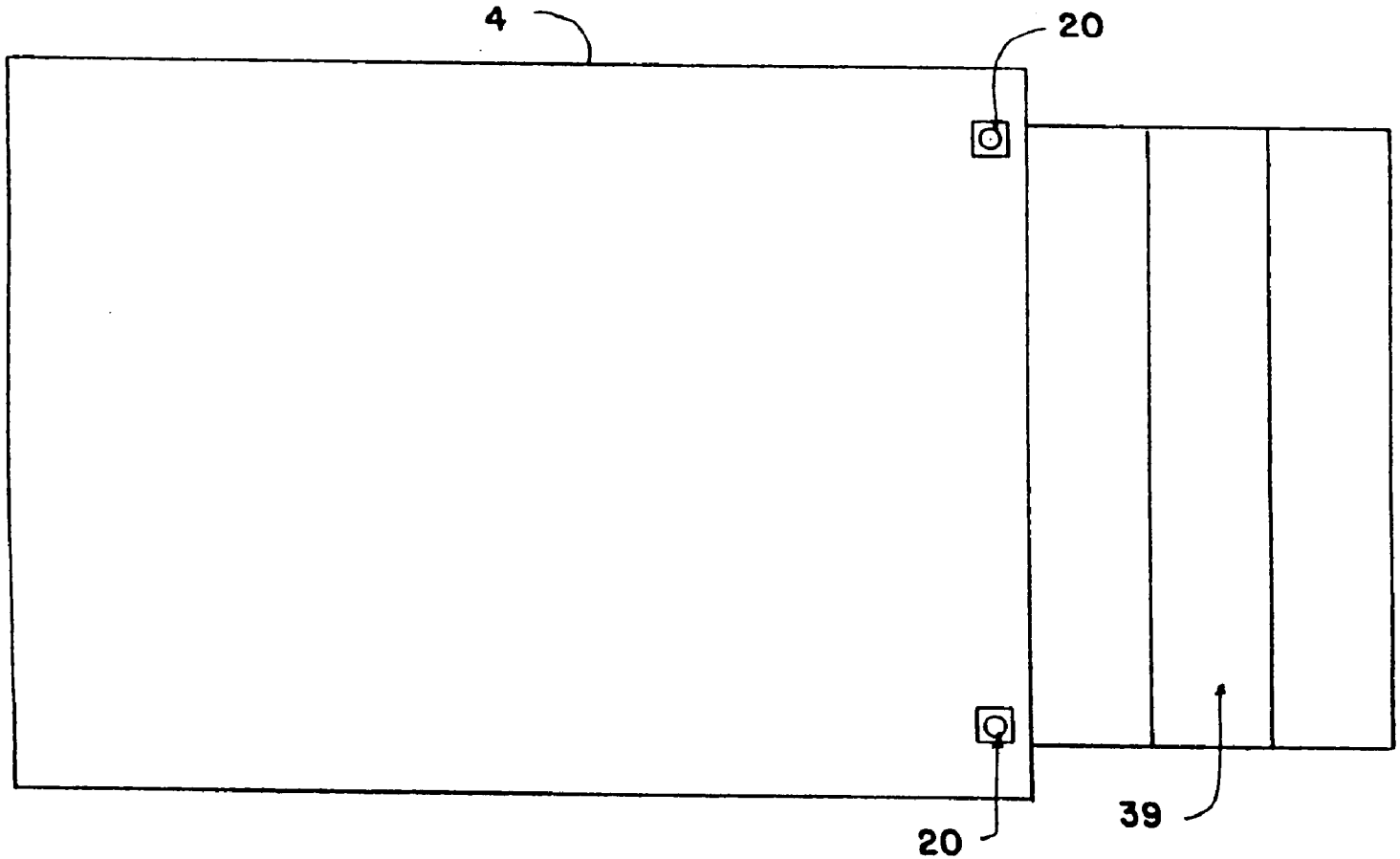
FIG. 6 is a planar view of the housing porch.
Figure 7:
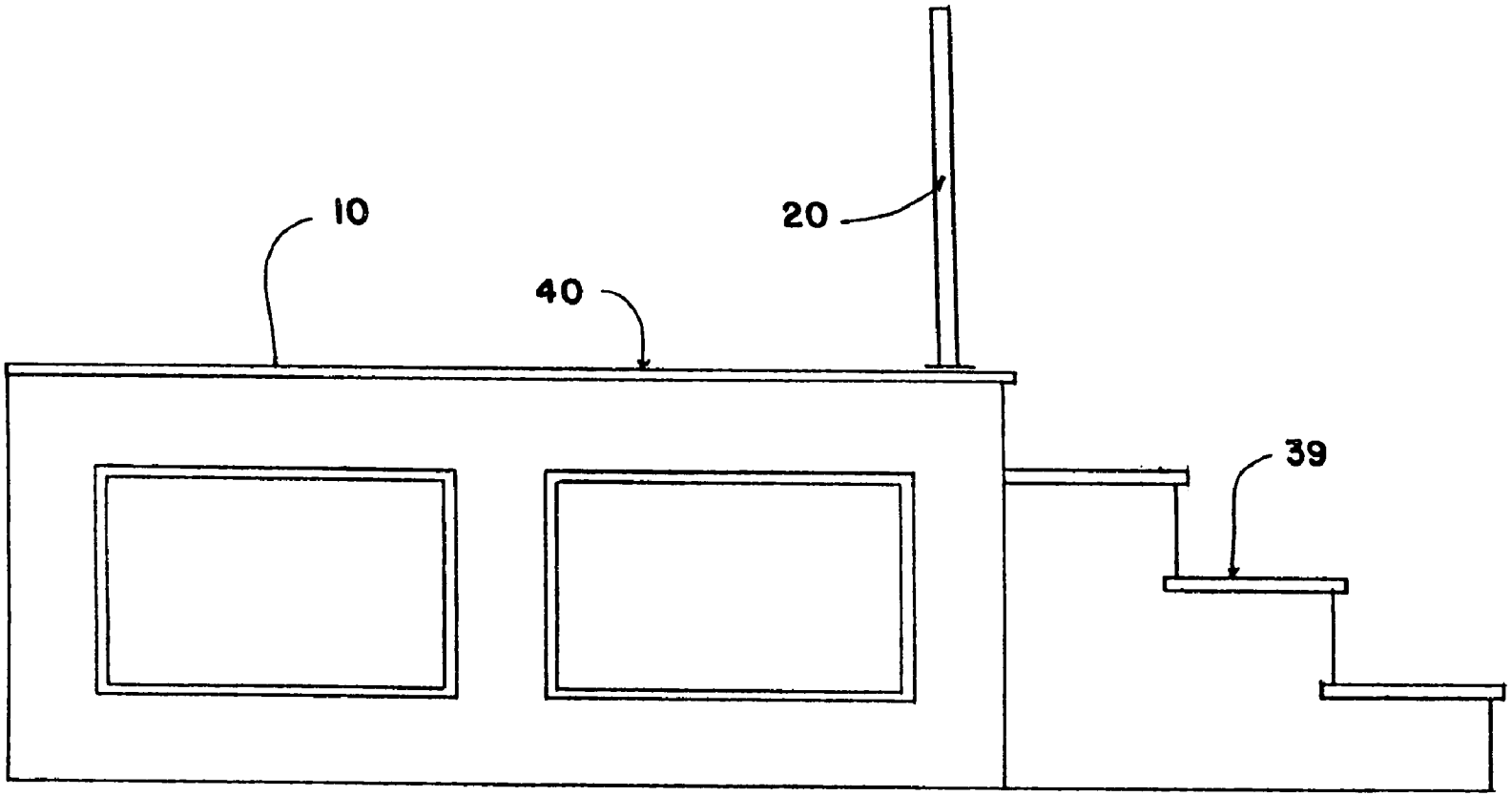
FIG. 7 is the side planar view of the housing porch with the railing posts and the door/steps.

Porch assembly 4 (shown in FIG. 6) with door/steps 39 is attached to the entranceway of a home or business (not shown). It also houses the telescoping ramp (shown in FIG. 9). Porch assembly 4 is constructed of wood; frame, and siding, or other suitable material (shown in FIG. 7).

Figure 8:
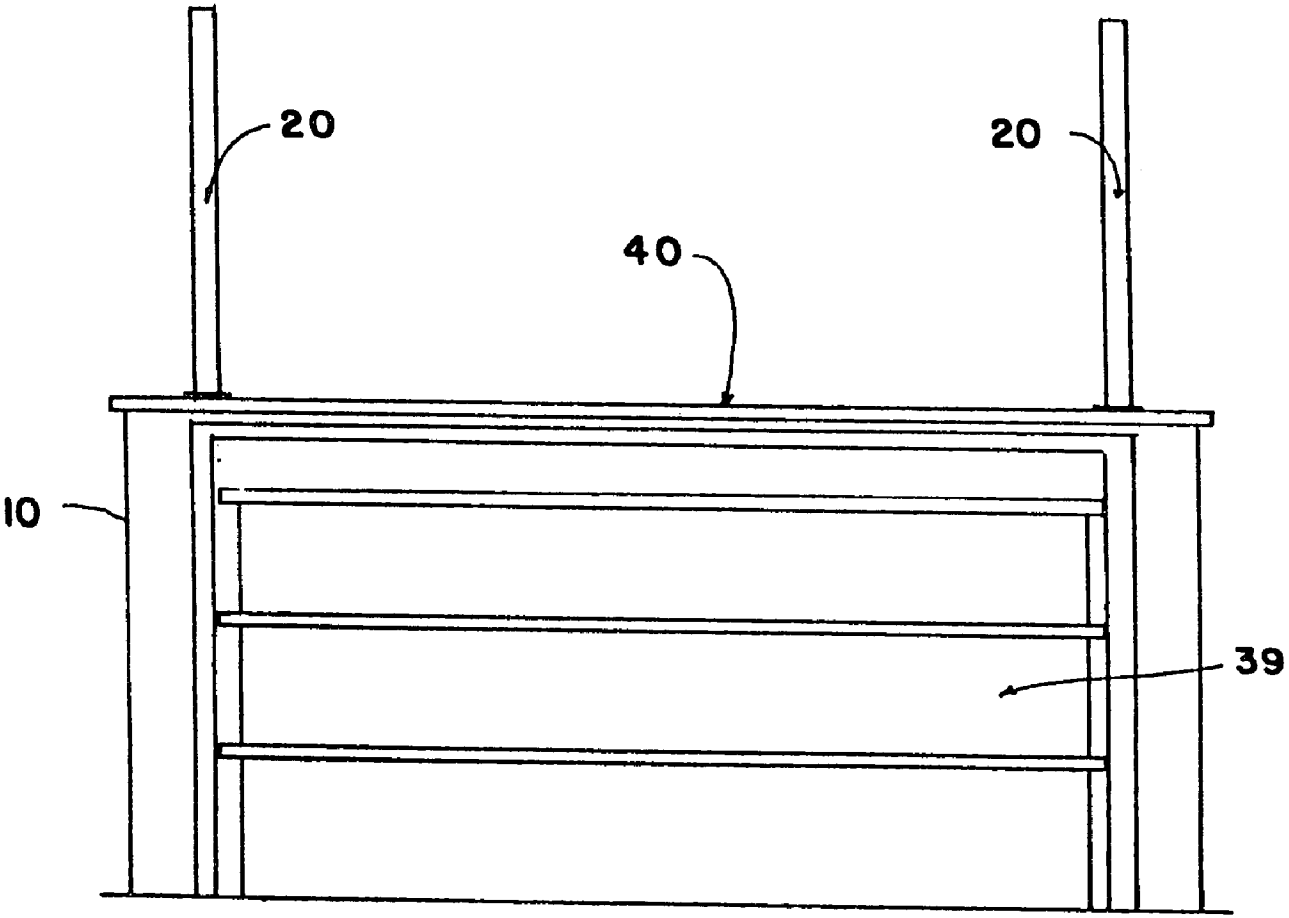
FIG. 8 is a front view of the porch and the swinging door with attached steps.

Porch assembly 4 (shown in FIG. 6) includes swinging door/steps 39 (a set of steps attached to the door's outside face) that swings open (shown in FIG. 9) and shut (shown in FIG. 8) as the telescoping ramp extends and retracts from inside the porch (shown in FIG. 1). The swinging door assembly (shown in FIG. 8) is the full height and width of porch 10 and is attached to porch 10 by way of known spring hinges and secured shut by way of a known magnetic lock system. The bottom edge of the swinging door and the bottom edge of the lowest step (shown in FIG. 7) have wheels 9 attached (not visible) which aid in the swinging movement and the support of door/step assembly 39.

Door/steps 39 run from porch deck 40 to runway 11 when the ramp assembly (shown in FIG. 8) is retracted and the door/steps is closed. The door/steps (shown in FIG. 9) swings open and to the side as the ramp extends from under porch 10. It remains open at the side of the largest ramp section when the ramp assembly is fully extended (shown in FIG. 1).

Porch 10 includes a known all weather non-skid material, which covers porch deck 40. It also includes two railing posts 20 which are located at the entrance to the extended ramp and connect with railings 18 on the extended ramp assembly (shown in FIG. 1).

Figure 43:
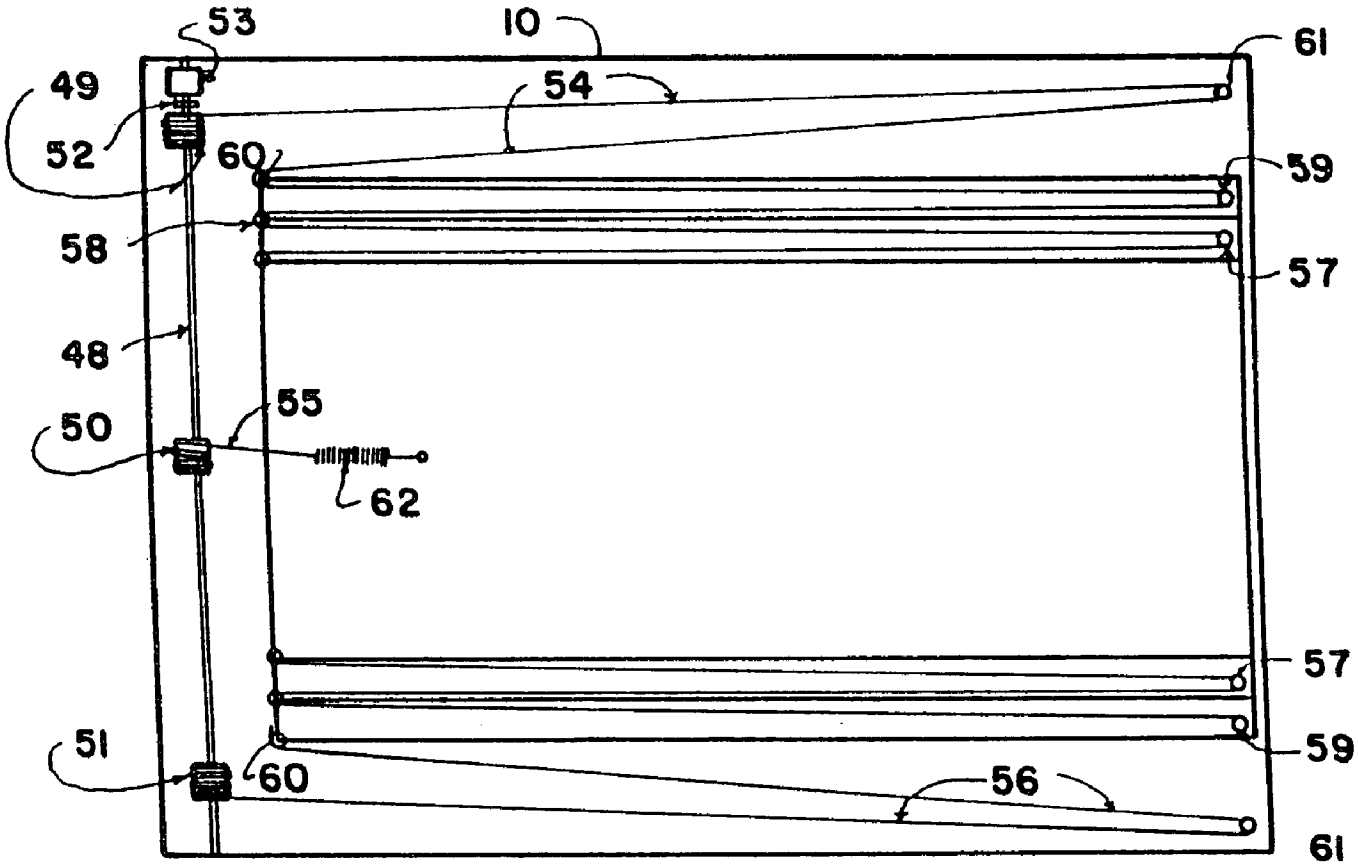
FIG. 43 is a top planar view of the cable/pulley/drum assembly as it fits inside the retracted telescoping ramp, which is sitting underneath the housing porch.
Figure 47:
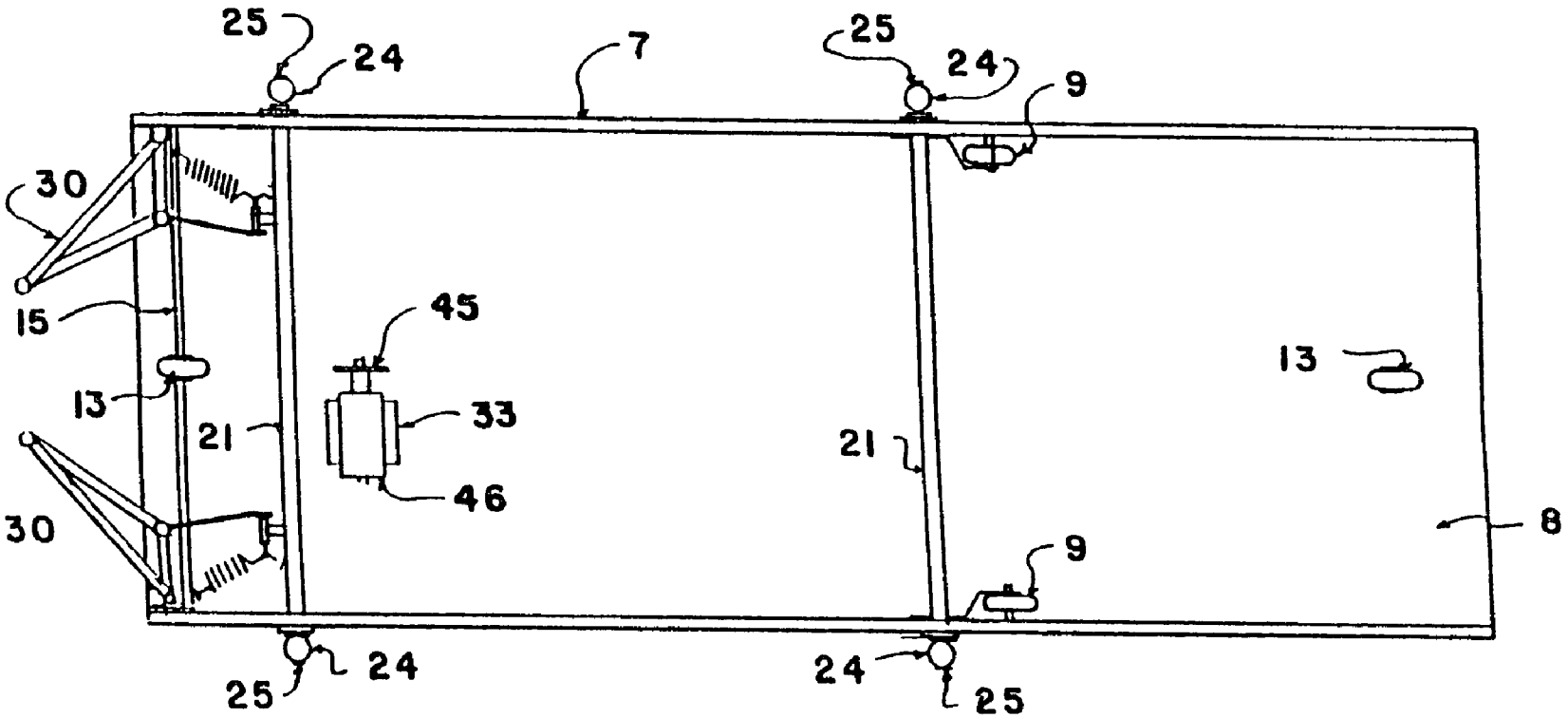
FIG. 47 is the planar view of the underside of the deck of the lowest ramp section showing a plan view of the sprocket wheel/cog chain drive assembly; the claw assembly which is a component of the ramp linkage assembly; and the ramp guide wheels.

There are three motorized drive assemblies: wheel/axle assembly (shown in FIG. 42) pulley/cable/drum assembly (shown in FIG. 43) and sprocket/chain assembly (shown in FIG. 47).

The wheel/axle assembly (shown in FIG. 3) is mounted underneath and at the back end of the lowest ramp section 1. Wheel axle 41 with four drive wheels 42 mounted to it runs between the two side walls. Also mounted to the center of axle 41 and between the two sets of drive wheels 42, is sprocket 43. Steel chain 44 connects sprocket 43 to sprocket 45 mounted on motor 46 which itself is mounted to the underside of deck 8 (shown in FIG. 42). Electric motor 46 includes extension cord 47 which is connected to an outlet on the back inside wall of porch 10 and extends and retracts from a known spring take-up reel assembly as the ramp extends and retracts.

When activated the motorized axle assembly (shown in FIG. 42) drives lowest ramp 1 forward and backward, making it the "train engine" that pulls/pushes the other ramp sections 2, 3 into and out of housing porch 10.

The pulley/cable/drum assembly (shown in FIG. 43) is attached to each ramp section 1,2,3 and porch assembly 4. This assembly (shown in FIG. 43) includes rotating axle 48 which runs between the two side walls of porch 10. Mounted to axle 48 are three drums 49,50,51 and a sprocket 52 set to the side. A steel chain (not shown) connects sprocket 52 with the sprocket (not shown) mounted on motor 53 which itself is mounted on the side wall of porch 10.

The pulley/cable/drum assembly (shown in FIG. 43) includes three cables 54, 55, 56 each one being attached at its one end to a drum 49,50,51. At the other end, middle cable 55 is anchored to the rear underside of lowest ramp 1 deck 8 and the other two 54, 56 are anchored at each side at the rear underside of the #1 ramp deck 8. In between their two ends, each of the two side cables 54,56 runs through five sets of pulleys 57,58,59,60,61 that are attached to the front and back of the underside of the decks of ramp sections 2,3 and the front of porch 10. The end of center cable 55, which is anchored to ramp section 1 includes a spring 62 for the purpose of holding cable 55 taut while the ramp is extended.

When activated the pulley/cable/drum assembly (shown in FIG. 43) pulls the ramp assembly (shown in FIG. 1) out by way of two side drive cables 54.56 winding onto two side drums 49,51 while at the same time center cable 55 is winding off center drum 50. When the ramp assembly (shown in FIG. 1) is being retracted center cable 55 winds onto center drum 50 while at the same time two side cables 54,56 are unwinding.

The telescoping ramp assembly (shown in FIG. 46) can also be powered manually. This is done with the aid of fork handle 63 being attached to the front sides of lowest ramp section 1.

Figure 48:
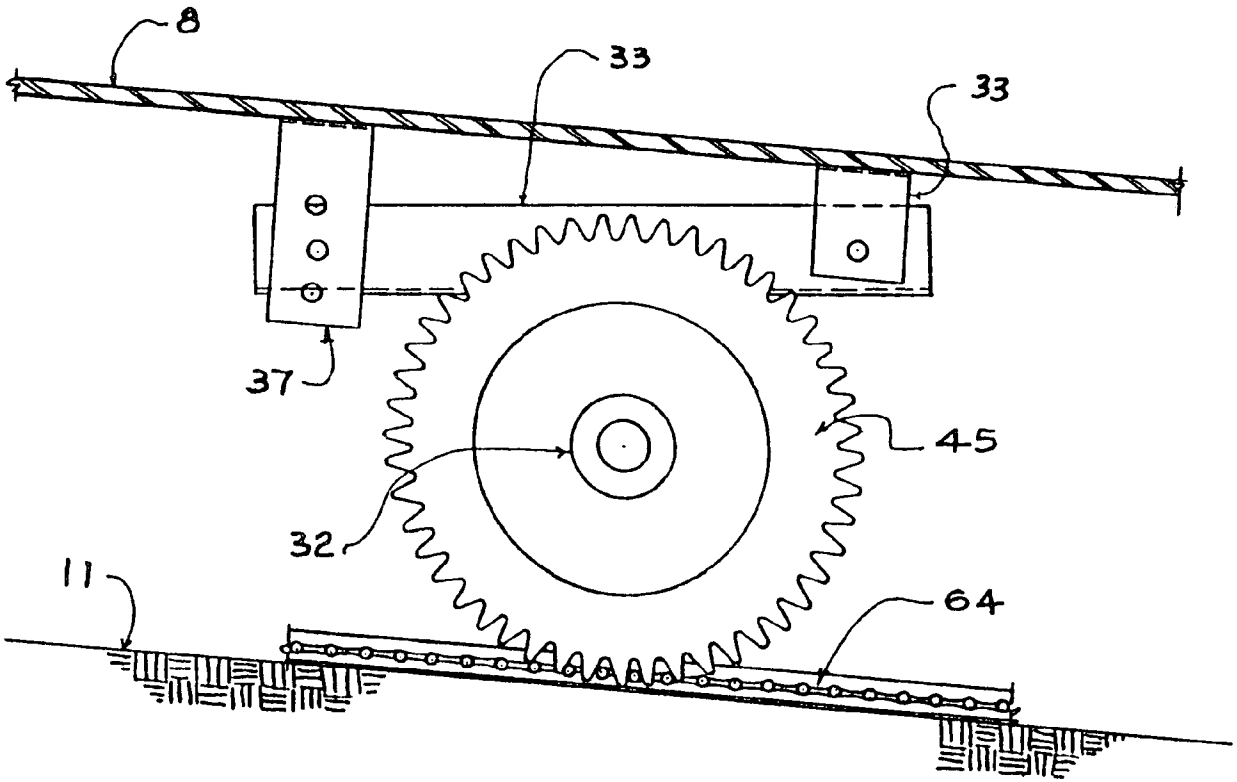
FIG. 48 is a side planar view of the sprocket wheel/cog chain drive assembly showing the drive sprocket wheel attached to the underside of the deck; and the drive cog chain mounted in the guide channel, which is centered in the runway.

The sprocket wheel/cog chain assembly (shown in FIG. 47) is mounted to lowest ramp 1 and runway 11 (not shown) respectively. Sprocket wheel 45, which is mounted directly to motor 46, sits centered underneath and near to the back end of lowest ramp section 1. This motor/sprocket wheel assembly (shown in FIG. 48) is so mounted as to permit the sprockets of wheel 45 to engage with chain 64, which is mounted in centered guide channel 69 on runway 11 directly beneath sprocket wheel 45 and runs the full length of runway 11.

Figure 49:
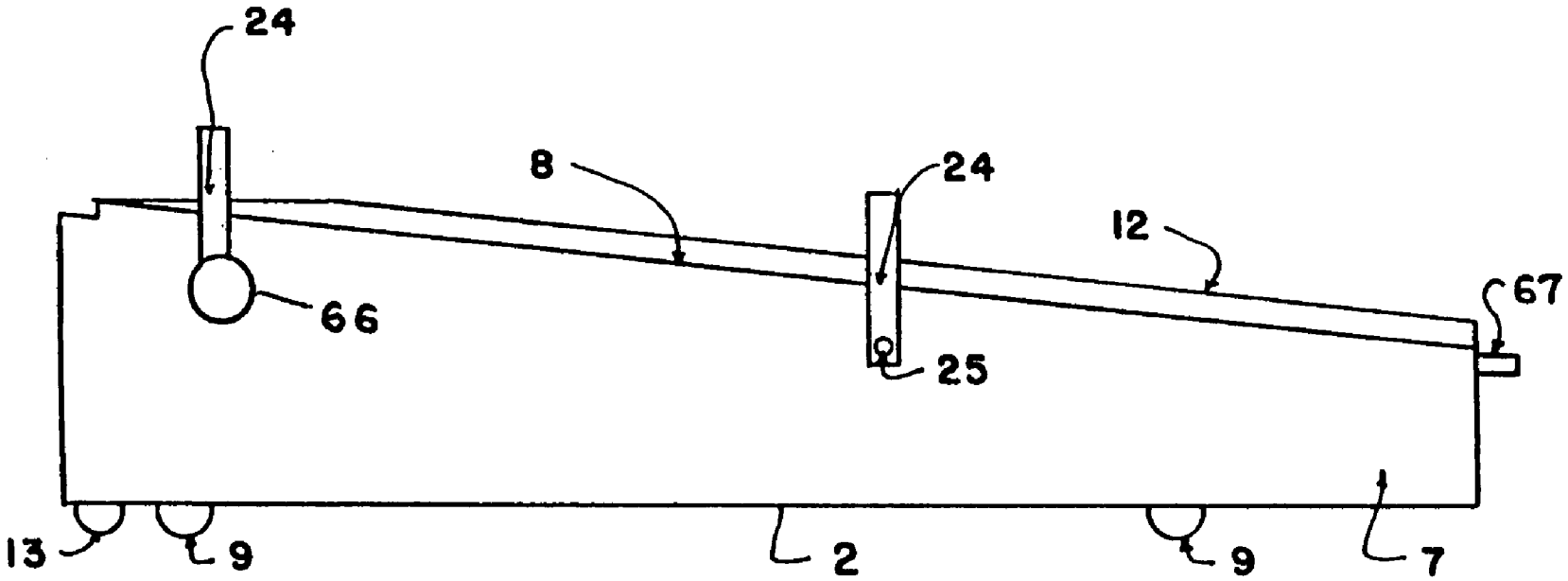
FIG. 49 is a side planar view of ramp section 2 with the rail post sprocket wheel attached to the drive axle (which runs through and is attached to the center of the rail post base) and the protruding rail cog chain attached to the top front underside of the side wall.
Figure 50:
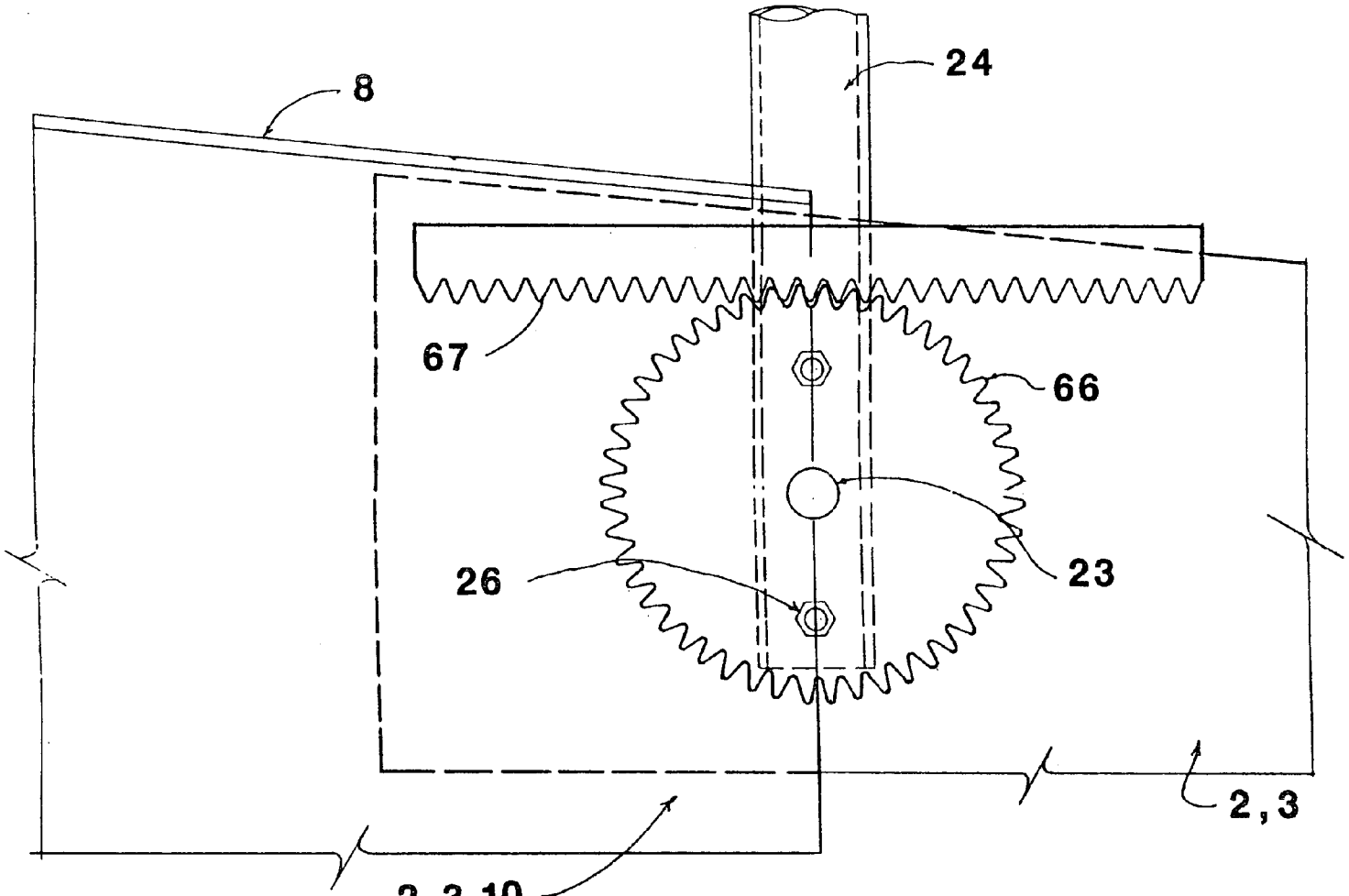
FIG. 50 is a side planar view of the rail post sprocket wheel mounted to the rail post base and drive axle engaging the rail cog chain which is mounted to the top front inside of the side wall of the adjacent ramp section.

Rail post sprocket wheel 66 and rail cog chain 67 assembly (shown in FIG. 49) raises and lowers railing 5. Rail post sprocket wheel 66 (shown in FIG. 50) is attached to rear drive axle 23 and rail post base 24 on both sides of each ramp section 1, 2, 3. Sprocket wheel 66 engages with rail cog chain 67, which is attached to the front inside walls of ramp sections 2, 3 and porch 10. When rail cog chain 67 is engaged with rail post sprocket wheel 66 on adjacent ramp section 1, 2, 3, this assembly (shown in FIG. 50) raises and lowers railings 5 when the ramp assembly (shown in FIG. 1) is extending and retracting.

The foregoing specification sets forth the invention in its preferred, practical forms but the structure shown is capable of modification within a range of equivalents without departing from the invention which is to be understood is broadly novel as is commensurate with the appended claims.

We claim:

1. A telescoping ramp assembly for interconnection to the entranceway of a structure, comprising:

one or more ramp sections joined together and capable of selective linear extension away from the entranceway to the use disposition and selective linear retraction adjacent to the entranceway to an interfitting, nested non-use disposition with each ramp having a sloping upper surface and an underside;

a plurality of wheels with at least one wheel mounted to the underside of each ramp section to facilitate the extension and retraction of that ramp section;

a runway disposed on the ground surface for supporting the ramp sections and upon which the wheels of the ramp sections travel during the extension and retraction of the ramp sections;

a porch assembly adjoined to the structure for housing the retractable and extensible ramp sections;

motorized extension and retraction means mounted to the underside of one ramp section for selectively driving that ramp section in order to initiate the extension of all the ramp sections from the porch assembly and the retraction of all the ramp sections into the porch assembly; and, a pulley assembly mounted to the underside of the ramp sections and including a plurality of cables mounted to a plurality of drums and pulleys so that the cables wind and unwind during retraction and extension of the ramp sections in order to drive the movement of the ramps sections during extension and retraction.

2. The telescoping ramp assembly of claim 1 comprises a plurality of handrails pivotally mounted to the ramps sections with one or two handrails mounted to each ramp section for pivotal movement between a pulled-up use disposition and a folded down non-use disposition concomitant with the extension and retraction of the ramp sections;

a linkage assembly mounted to each ramp section and including two claws and two grab brackets mounted to the underside of each ramp section so that the claws of one ramp section engage the grab brackets of the adjacent ramp section during the extension of the ramp sections and the claws of one ramp section disengage from the grab brackets of the adjacent ramp section to allow for the retraction of the ramp sections.

3. A telescoping ramp assembly for interconnection to the entranceway of a structure, comprising:

one or more ramp sections joined together and capable of selective linear extension away from the entranceway to the use disposition and selective linear retraction adjacent to the entranceway to an interfitting, nested non-use disposition with each ramp having a sloping upper surface and an underside;

a plurality of wheels with at least one wheel mounted to the undersides of each ramp section to facilitate the extension and retraction of that ramp section;

a plurality of handrails pivotally mounted to the ramps sections with one pair of handrails mounted to each ramp section for pivotal movement between a pulled-up use disposition and a folded down non-use disposition concomitant with the extension and retraction of the ramp sections;

a linkage assembly mounted to each ramp section and including two claws and two grab brackets mounted to the underside of each ramp section so that the claws of one ramp section engage the grab brackets of the adjacent ramp section during the extension of the ramp sections and the claws of one ramp section disengage from the grab brackets of the adjacent ramp section to allow for the retraction of the ramp sections;

a runway disposed on the ground surface for supporting the ramp sections and upon which the wheels of the ramp sections travel during the extension and retraction of the ramp sections;

a porch assembly adjoined to the structure for housing the retractable and extensible ramp sections; and, a pulley assembly mounted to the underside of the ramp sections and including a plurality of cables mounted to a plurality of drums and pulleys so that the cables wind and unwind during retraction and extension of the ramp sections in order to stabilize the movement of the ramps sections during extension and retraction.

4. The telescoping ramp assembly of claim 3 further comprising a motorized extension and retraction means mounted to the underside of one ramp section for selectively driving that ramp section in order to initiate the extension of all the ramp sections from the porch assembly and the retraction of all the ramp sections into the porch assembly.

5. A telescoping ramp assembly for interconnection to the entranceway of a structure, comprising:

two or more ramp sections joined together and capable of selective linear extension away from the entranceway to the use disposition and selective linear retraction adjacent to the entranceway to an interfitting, nested non-use disposition with each ramp having a sloping upper surface and an underside;

a plurality of wheels with at least one wheel mounted to the underside of each ramp section to facilitate the extension and retraction of that ramp section;

a plurality of handrails pivotally mounted to the ramps sections with at least one handrail mounted to each ramp section for pivotal movement between a pulled-up use disposition and a folded down non-use disposition concomitant with the extension and retraction of the ramp sections;

a linkage assembly mounted to each ramp section and including two claws and two grab brackets mounted to the underside of each ramp section so that the claws of one ramp section engage the grab brackets of the adjacent ramp section during the extension of the ramp sections and the claws of one ramp section disengage from the grab brackets of the adjacent ramp section to allow for the retraction of the ramp sections;

a runway disposed on the ground surface for supporting the ramp sections and upon which the wheels of the ramp sections travel during the extension and retraction of the ramp sections;

a porch assembly adjoined to the structure for housing the retractable and extensible ramp sections; and, a motorized extension and retraction means mounted to the underside of one ramp section for selectively driving that ramp section in order to initiate the extension of all the ramp sections from the porch assembly and the retraction of all the ramp sections into the porch assembly.

6. The telescoping ramp assembly of claim 5 further comprising a pulley assembly mounted to the underside of the ramp sections and including a plurality of cables mounted to a plurality of drums and pulleys so that the cables wind and unwind during retraction and extension of the ramp sections in order to drive the movement of the ramps sections during extension and retraction.

7. A telescoping ramp assembly for interconnection to the entranceway of a structure, comprising:

at least two ramp sections joined together and capable of selective linear extension away from the entranceway to the use disposition and selective linear retraction adjacent to the entranceway to an interfitting, nested non-use disposition with each ramp having a sloping upper surface and an underside;

a plurality of wheels with at least one wheel mounted to the underside of each ramp section to facilitate the extension and retraction of that ramp section;

a plurality of handrails pivotally mounted to the ramps sections with at least one handrail mounted to each ramp section for pivotal movement between a pulled-up use disposition and a folded down non-use disposition concomitant with the extension and retraction of the ramp sections;

a linkage assembly mounted to each ramp section and including two claws and two grab brackets mounted to the underside of each ramp section so that the claws of one ramp section engage the grab brackets of the adjacent ramp section during the extension of the ramp sections and the claws of one ramp section disengage from the grab brackets of the adjacent ramp section to allow for the retraction of the ramp sections;

a runway disposed on the ground surface for supporting the ramp sections and upon which the wheels of the ramp sections travel during the extension and retraction of the ramp sections;

a porch assembly adjoined to the structure for housing the retractable and extensible ramp sections;

motorized extension and retraction means mounted to the underside of one ramp section for selectively driving that ramp section in order to initiate the extension of all the ramp sections from the porch assembly and the retraction of all the ramp sections into the porch assembly; and, a pulley assembly mounted to the underside of the ramp sections and including a plurality of cables mounted to a plurality of drums and pulleys so that the cables wind and unwind during retraction and extension of the ramp sections in order to stabilize the movement of the ramps sections during extension and retraction.

8. The telescoping ramp assembly of claim 7 wherein the ramp sections include a first smaller ramp section, a second intermediate ramp section and a third largest ramp section, and all the ramp sections include a sloping deck so that when the ramp sections are extended the sloping decks form a continuous inclined deck surface.

9. The telescoping ramp assembly of claim 8 further comprising a plurality of railing post base fittings with one pair of railing post base fittings pivotally mounted to each side of each ramp section and the railing post base fittings on one side of each ramp section being in parallel alignment with the railing post base fittings on the other side of the respective ramp sections.

10. The telescoping ramp assembly of claim 9 further comprising a plurality of railing posts with each railing post having a lower post end securable to the railing post base fittings and an upper post end attachable to the handrails.

11. The telescoping ramp assembly of claim 10 wherein each ramp section includes four railing posts with two railing posts located on each side of the respective ramp sections and the railing posts on one side of each ramp section being in parallel alignment with the railing posts on the opposite side of each ramp section.

12. The telescoping ramp assembly of claim 11 further comprising a plurality of rotatable axle rods with two axle rods extending beneath the sloping deck of each ramp section for interconnecting both pairs of railing post base fittings that are located on opposite sides of each ramp section.

13. The telescoping ramp assembly of claim 12 further comprising a plurality of saddle-shaped members with each ramp section having two saddle-shaped members located on each side of that ramp section and the saddle-shaped members being mounted to the upper post end of each railing post for connecting the handrails to the railing posts.

14. The telescoping ramp assembly of claim 13 further comprising a plurality of hand rail connections for connecting the hand rails of each ramp to its adjoining ramp hand rails thereby providing a continuous railing when the ramp is in its use disposition.

15. The telescoping ramp assembly of claim 14 wherein the pairs of axle rods for each ramp section interconnect the railing post base fittings, the railing posts and the handrails so that the pivotal movement of the handrail on one side of each ramp section is transmitted by the respective axle rod to the handrail on the opposite side of that ramp section so that each pair of handrails for each ramp section can be raised or lowered as a unit.

16. A ramp assembly attachable to a dwelling and having extensible and retractable sections that fit one inside the other in the non-use disposition and telescope from each other to the use disposition, the ramp assembly, comprising:

a first smallest ramp section, a second intermediate ramp section, and a third largest ramp section with each ramp section having a sloping upper deck, opposed side panels and an underside, and the ramp sections interconnected for selective linear extension to the use disposition and selective linear retraction to the non-use disposition;

the ramp sections telescoping out from each other during extension to the use disposition and nesting inside each other when retracted to the non-use disposition;

at least one guide wheel mounted to the lower portion of each ramp section for facilitating the slidable extensible and retractable movement of the ramp sections to the use disposition and the non-use disposition;

a pair of handrails pivotally mounted to each side panel of each ramp section with all the pairs of handrails capable of pivotal movement between a pulled-up position above the sloping decks of the ramp sections and a folded down position adjacent the side panels of the ramp sections;

a linkage assembly mounted to each ramp section and including two claws and two grab brackets mounted to the underside of each ramp section so that the claws of one ramp section engage the grab brackets of the adjoining ramp section during the extension of the ramps sections and the claws of each ramp section capable of disengagement from the grab brackets of the adjoining ramp section in order to permit the retraction of the ramp sections;

a runway disposed on the ground surface for supporting the ramp sections during their extensible and retractable movement and the runway including a runway channel in which the guide wheels travel during the extension and retraction of the ramp sections;

a porch assembly connected to the ramp assembly for housing the ramp sections in a nested, interfitting relationship when the ramp sections are retracted within the porch assembly;

motorized extension and retraction means mounted to the underside of the first ramp section for selectively driving the first ramp section in a linear direction thereby initiating the extension and retraction of the second ramp section and the third ramp sections; and, a pulley assembly mounted to the underside of the ramp sections and including a plurality of cables wound about a plurality of drums and pulleys so that the cables wind and unwind during retraction and extension of the ramp sections in order to stabilize the movement of the ramp sections during the retraction and extension.

17. The ramp assembly of claim 16 wherein the sloping decks of the first, second and third ramp sections form a continuous inclined deck surface when the ramp sections are extended from the porch assembly to the use disposition.

18. The ramp assembly of claim 17 further comprising a plurality of railing post base fittings with one pair of railing post base fittings pivotally mounted to each side panel of each ramp section and the railing post base fittings on one side panel being in parallel alignment with the railing post base fittings on the other side panel.

19. The ramp assembly of claim 18 further comprising a plurality of railing posts with each railing post having a lower post end securable to one railing post base fitting and an upper post end attachable to the respective handrail adjacent the side panel of that ramp section.

20. The ramp assembly of claim 19 wherein each ramp section further includes four railing posts with two railing posts positioned at each side panel of each ramp section and the railing posts adjacent one side panel being in parallel alignment with the railing posts located adjacent the opposite side panel.

21. The ramp assembly of claim 20 further comprising a plurality of saddle-shaped members with each ramp section having two saddle-shaped members located at each side panel and the saddle-shaped members being mounted to the upper post ends for interconnecting the handrails to the railing posts.

22. The ramp assembly of claim 21 further comprising a plurality of axle rods with two axle rods extending transversely beneath the sloping deck of each ramp section for interconnecting both pairs of oppositely disposed railing post base fittings for each ramp section.

23. The ramp assembly of claim 22 wherein the respective pairs of axle rods for each ramp section interconnect the railing post base fittings, the railing posts and the handrails adjacent each side panel of each ramp section so that the pivotal movement of the handrail adjacent one side panel is transmitted by the respective axle rods to the opposite railing post base fittings, the railing posts and the handrails so that each pair of handrails for each ramp section can be raised and lowered simultaneous as a unit.

24. A ramp assembly attachable to a dwelling and having ramp sections that extend and retract upon a runway for moving between a use disposition and a non-use disposition, comprising:

a first smallest ramp section, a second intermediate ramp section, and a third largest ramp section with each ramp section having a sloping deck, opposed side panels and an underside, the ramp sections being interconnected for selective linear movement upon the runway for extension to the use disposition and retraction to the non-use disposition;

the runway secured to the ground surface for supporting the extensible and retractable movement of the ramp sections with the length of the runway being at least equal to the length of the ramp assembly when the ramp assembly is fully extended;

at least one guide wheel mounted to the lower portion of each ramp section for movement along the runway in order to facilitate the extension and retraction of the ramp sections;

a pair of handrails pivotally mounted to each ramp section with one handrail located on each side panel of each ramp section and the handrails capable of pivotal movement between a pulled-up position and a folded-down position and the handrails of all the ramp sections being interconnected so that the handrails can be simultaneously raised and lowered;

linkage means for locking the ramp sections to one another as the first ramp section extends out from the second ramp section and the second ramp section extends out from the third ramp section and for unlocking the ramp sections as the first ramp section is retracted into the second ramp section and the second ramp section is retracted into the third ramp section;

motorized extension and retraction means mounted to the underside of the first ramp section for selectively driving the first ramp section in a linear direction thereby initiating the extension and retraction of the second ramp section and the third ramp section; and, a pulley assembly mounted to the underside of the ramp sections and including a plurality of cables wound about a plurality of drums and pulleys so that the cables wind and unwind during retraction of the ramp sections and extension of the ramp sections in order to drive the linear movement of the ramp sections upon the runway.

25. The ramp assembly of claim 24 further comprising a porch assembly interposed between the dwelling and the ramp sections for housing the ramp sections in a nested disposition when the ramp sections are fully retracted within the porch assembly and out of which the ramp sections extend when being disposed to the use disposition.

26. The ramp assembly of claim 25 wherein the linkage means includes a pair of claws and a pair of grab brackets mounted to the underside of each ramp section so that the claws of each ramp section engage the grab brackets of the adjacent ramp section for locking the first ramp section to the second ramp section and the second ramp section to the third ramp section when the ramp assembly is fully extended.

27. The ramp assembly of claim 26 wherein the claws of each ramp section are disengageble from the grab brackets of each adjacent ramp section so that the first ramp section can be disengaged from the second ramp section and the second ramp section can be disengaged from the third ramp section in order for the ramp sections to be retracted within the porch assembly in a nested disposition.

28. The ramp assembly of claim 27 wherein the sloping decks of the first, second and third ramp sections form a continuous inclined deck surface when the ramp sections are fully extended from the porch assembly to the use disposition.

29. The ramp assembly of claim 28 further comprising a plurality of railing post base fittings with one pair of railing post base fittings pivotally mounted to each side panel of each ramp section and the railing post base fittings on one side panel being in parallel alignment with the railing post base fitting on the opposite side panel.

30. The ramp assembly of claim 29 further comprising a plurality of railing posts with each railing post having a lower post end securable to one railing post base fitting and an upper post end attachable to the respective handrail that is adjacent the side panel of that ramp section.

31. The ramp assembly of claim 30 wherein each ramp section further includes four railing posts with two railing posts positioned adjacent each side panel of each ramp section and the railing posts along one side panel being in parallel alignment with the railing posts adjacent the opposite side panel.

32. The ramp assembly of claim 31 further comprising a plurality of saddle-shaped members with each ramp section having two saddle-shaped members located along each side panel of each ramp section and the saddle-shaped members being mounted to the upper post ends of the railing posts for interconnecting the handrails to the railing posts.

33. The ramp assembly of claim 32 further comprising a plurality of axle rods with two axle rods extending transversely between beneath the sloping deck of each ramp section for interconnecting both pairs of oppositely disposed railing post base fittings located adjacent each side panel of each ramp section.

34. The ramp assembly of claim 33 wherein the respective pairs of axle rods for each ramp section interconnect the railing post base fittings, the railing posts and the handrails adjacent the side panels of the ramp sections so that the pivotal movement of the handrail adjacent one side panel is communicated to the opposite railing post base fittings, railing posts and handrails by the respective axle rods so that each pair of handrails for each ramp section can be simultaneously raised and lowered as a unit.

* * * * *